US009375048B2

(12) United States Patent
James et al.

(10) Patent No.: US 9,375,048 B2
(45) Date of Patent: Jun. 28, 2016

(54) ARTICLE OF FOOTWEAR HAVING ADJUSTABLE SOLE STRUCTURE

(71) Applicant: Nike, Inc., Beaverton, OR (US)

(72) Inventors: Dervin A. James, Hillsboro, OR (US); Fred G. Fagergren, Hillsboro, OR (US); Taryn M. Hensley, Portland, OR (US)

(73) Assignee: NIKE, Inc., Beaverton, OR (US)

( * ) Notice: Subject to any disclaimer, the term of this patent is extended or adjusted under 35 U.S.C. 154(b) by 439 days.

(21) Appl. No.: 13/729,692

(22) Filed: Dec. 28, 2012

(65) Prior Publication Data

US 2014/0182167 A1 Jul. 3, 2014

(51) Int. Cl.
*A43B 13/18* (2006.01)
*A43B 7/14* (2006.01)

(52) U.S. Cl.
CPC ..... *A43B 13/189* (2013.01); *A43B 7/1465* (2013.01); *A43B 13/181* (2013.01); *A43B 13/187* (2013.01); *A43B 13/188* (2013.01)

(58) Field of Classification Search
CPC ..... A43B 7/14; A43B 13/206; A43B 13/18; A43B 13/184; A43B 21/32; A43C 1/00
USPC ..... 36/50.1, 50.5, 102, 28, 29, 97, 27, 37, 36/38
See application file for complete search history.

(56) References Cited

U.S. PATENT DOCUMENTS 2,756,517 A * 7/1956 Youtz ..... 36/7.8
4,183,156 A 1/1980 Rudy
4,219,945 A 9/1980 Rudy
4,340,626 A 7/1982 Rudy
4,391,048 A * 7/1983 Lutz ..... 36/28
4,936,029 A 6/1990 Rudy
5,042,176 A 8/1991 Rudy
5,343,639 A * 9/1994 Kilgore et al. ..... 36/29
5,713,141 A 2/1998 Mitchell et al.
5,934,599 A 8/1999 Hammerslag
5,952,065 A 9/1999 Mitchell et al.
6,013,340 A 1/2000 Bonk et al.
6,032,387 A * 3/2000 Johnson ..... 36/50.1

(Continued)

FOREIGN PATENT DOCUMENTS

FR 465267 A 4/1914
WO 03/043455 A1 5/2003
WO 2011/109541 A1 9/2011

OTHER PUBLICATIONS

International Search Report and Written Opinion mailed Jul. 28, 2014 in PCT/US2013/077500.

(Continued)

*Primary Examiner* — Khoa Huynh
*Assistant Examiner* — Megan Brandon
(74) *Attorney, Agent, or Firm* — Honigman Miller Schwartz and Cohn LLP; Matthew H. Szalach; Jonathan P. O'Brien

(57) ABSTRACT

The present disclosure is directed to an article of footwear. The article of footwear having an upper for receiving a foot and a sole structure secured to the upper. The sole structure may include at least one support member. In addition, the sole structure may include a tensile member associated with the at least one support member and a tensioning device configured to selectively alter one or more properties of the at least one support member, by tightening and loosening the tensile member.

20 Claims, 17 Drawing Sheets

(56) References Cited

U.S. PATENT DOCUMENTS

| | | | | |
|---|---|---|---|---|
| 6,052,921 | A * | 4/2000 | Oreck | 36/50.1 |
| 6,082,025 | A | 7/2000 | Bonk et al. | |
| 6,115,943 | A * | 9/2000 | Gyr | 36/35 R |
| 6,127,026 | A | 10/2000 | Bonk et al. | |
| 6,202,953 | B1 | 3/2001 | Hammerslag | |
| 6,203,868 | B1 | 3/2001 | Bonk et al. | |
| 6,321,465 | B1 * | 11/2001 | Bonk et al. | 36/28 |
| 6,487,796 | B1 * | 12/2002 | Avar et al. | 36/28 |
| 6,689,558 | B2 | 2/2004 | Case | |
| 6,837,951 | B2 | 1/2005 | Rapaport | |
| 7,000,335 | B2 | 2/2006 | Swigart et al. | |
| 7,210,249 | B2 | 5/2007 | Passke et al. | |
| 7,591,084 | B2 | 9/2009 | Santa Ana | |
| 2004/0181972 | A1 * | 9/2004 | Csorba | 36/50.1 |
| 2007/0266598 | A1 * | 11/2007 | Pawlus et al. | 36/102 |
| 2008/0313928 | A1 * | 12/2008 | Adams et al. | 36/103 |
| 2009/0151195 | A1 | 6/2009 | Forstrom et al. | |
| 2009/0151196 | A1 | 6/2009 | Schindler et al. | |
| 2010/0101111 | A1 * | 4/2010 | McDonnell | 36/29 |
| 2010/0186256 | A1 * | 7/2010 | Farina et al. | 36/29 |
| 2011/0126423 | A1 * | 6/2011 | Yang | 36/29 |
| 2011/0214313 | A1 * | 9/2011 | James et al. | 36/103 |
| 2012/0048663 | A1 * | 3/2012 | McDonnell | 188/266 |
| 2012/0102783 | A1 * | 5/2012 | Swigart et al. | 36/83 |
| 2012/0240428 | A1 * | 9/2012 | Knoll | 36/50.1 |
| 2014/0283412 | A1 * | 9/2014 | Elder et al. | 36/102 |
| 2014/0325870 | A1 * | 11/2014 | Lombardino | 36/27 |

OTHER PUBLICATIONS

Chao et al., U.S. Appl. No. 13/571,749, "Methods for Manufacturing Fluid-Filled Chambers Incorporating Spacer Textile Materials," filed Aug. 10, 2012.

* cited by examiner

ARTICLE OF FOOTWEAR HAVING ADJUSTABLE SOLE STRUCTURE

BACKGROUND

Articles of athletic footwear often include two primary elements, an upper and a sole structure. The upper provides a comfortable covering for the foot and securely positions the foot with respect to the sole structure. The sole structure is secured to a lower portion of the upper (for example, through adhesive bonding) and is generally positioned between the foot and the ground. In addition to attenuating ground reaction forces (that is, providing cushioning) during walking, running, and other ambulatory activities, the sole structure may influence foot motions (for example, by resisting pronation), impart stability, and provide traction. Accordingly, the upper and the sole structure operate cooperatively to provide a comfortable structure that is suited for a wide variety of athletic activities.

The upper is often formed from a plurality of material elements (for example, textiles, polymer sheets, foam layers, leather, and/or synthetic leather) that are stitched and/or adhesively bonded together to form a void on the interior of the footwear for receiving a foot. More particularly, the upper forms a structure that extends over instep and toe areas of the foot, along medial and lateral sides of the foot, and around a heel area of the foot. The upper may also incorporate a lacing system to adjust fit of the footwear, as well as permitting entry and removal of the foot from the void within the upper. In addition, the upper may include a tongue that extends under the lacing system to enhance adjustability and comfort of the footwear. Further, the upper may incorporate a heel counter to provide stability, rigidity, and support to the heel and ankle portion of the foot.

The sole structure may include one or more components. For example, the sole structure may include a ground-contacting sole component. The ground-contacting sole component may be fashioned from a durable and wear-resistant material (such as rubber or plastic), and may include ground-engaging members, tread patterns, and/or texturing to provide traction.

In addition, in some embodiments, the sole structure may include a midsole and/or a sockliner. The midsole may be secured to a lower surface of the upper and forms a middle portion of the sole structure. Many midsole configurations are primarily formed from a resilient polymer foam material, such as polyurethane or ethylvinylacetate, that extends throughout the length and width of the footwear. The midsole may also incorporate fluid-filled chambers, plates, moderators, or other elements that further attenuate forces, influence the motions of the foot, or impart stability, for example. The sockliner is a thin, compressible member located within the upper and positioned to extend under a lower surface of the foot to enhance footwear comfort.

Sole structures have been developed that utilize a plurality of support members, which, in some cases, may be generally cylindrical, to provide attenuation of ground reaction forces. Such systems can include support members of various sizes distributed about the midsole to provide cushioning and stability that is tailored to each region of the foot including, for example, the forefoot and/or heel region. However, these systems are not adjustable. While a user may, in some cases, substitute a different insole to provide a different cushioning and/or stability characteristics, the majority of cushioning and/or stability attributes are often provided by the midsole rather than the insole. Therefore, once the article of footwear is manufactured, the performance characteristics of the sole structure are substantially fixed because the characteristics of the midsole are not adjustable. It may be desirable to provide some adjustability for the attributes of the midsole in order to provide a higher level of customizability of the performance characteristics of footwear.

SUMMARY

In one aspect, the present disclosure is directed to an article of footwear having an upper for receiving a foot and a sole structure secured to the upper. The sole structure may include at least one support member. In addition, the sole structure may include a tensile member associated with the at least one support member and a tensioning device configured to selectively alter one or more properties of the at least one support member, by tightening and loosening the tensile member.

In another aspect, the present disclosure is directed to an article of footwear having an upper for receiving a foot and a sole structure secured to the upper. The sole structure may include a void having a first surface and an opposite second surface, the first surface being positioned adjacent to the upper, and the lower surface being positioned adjacent to a ground-engaging portion of the footwear. The sole structure may further include a plurality of support members located within the void and secured to the first surface and the second surface, and a tensile member extending adjacent to each of the support members. In addition, the article of footwear may include a tensioning device coupled to the tensile member and configured to selectively alter properties of the support members by tightening and loosening the tensile member.

In another aspect, the present disclosure is directed to an article of footwear having an upper for receiving a foot and a sole structure secured to the upper. The sole structure may include a void extending from a lateral side to a medial side of the sole structure in a heel region of the sole structure, the void forming an aperture extending entirely through the sole structure, and the void having a first surface and an opposite second surface, the first surface being positioned adjacent to the upper, and the lower surface being positioned adjacent to a ground-engaging portion of the footwear. The sole structure may further include a plurality of support members located within the void and secured to the first surface and the second surface, the support members including (a) a first support member located adjacent to the lateral side, (b) a second support member located adjacent to the lateral side and forward of the first support member, (c) a third support member located adjacent to the medial side, and (d) a fourth support member located adjacent to the medial side and forward of the third support member, and the support members defining indentations located between the first surface and the second surface. Also, the article of footwear may include a tensile member extending at least partially around each of the support members, the tensile member including a wire and a housing, the wire being located within the housing, and the housing being at least partially located within the indentations of the support members. In addition, the article of footwear may include a tensioning device coupled to the tensile member and configured to selectively alter properties of the support members by tightening and loosening the wire.

In another aspect, the present disclosure is directed to an article of footwear having an upper for receiving a foot and a sole structure secured to the upper. The sole structure may include a row of flexible elongate members extending substantially horizontally, each elongate member having a first portion, a second portion, and a third portion between the first portion and the second portion. The sole structure may also include at least one tensile member attached to a substantially rigid member at a first end of the row of elongate members. In addition, the article of footwear may include a wire tensioning device at a second end of the row of elongate members, the wire tensioning device being configured to pull the substantially rigid member toward the wire tensioning device, thereby pulling the third portion of each elongate member closer to the wire tensioning device, while the first and second portions of each elongate member remain substantially the same distance from the wire tensioning device, causing the first and second portions of each elongate member to become closer to one another, thereby narrowing the adjustable width component.

In another aspect, the present disclosure is directed to an article of footwear having an upper for receiving a foot and a sole structure secured to the upper. The adjustable width component may include an adjustable width component, which may include a row of flexible elongate members extending substantially horizontally, each elongate member having a first portion, a second portion, and a third portion between the first portion and the second portion. The sole structure may also include at least one tensile member attached to a substantially rigid member at a first end of the row of elongate members. In addition, the article of footwear may include a tensioning device at a second end of the row of elongate members, the tensioning device being configured to pull the substantially rigid member toward the tensioning device, thereby pulling the third portion of each elongate member closer to the tensioning device, while the first and second portions of each elongate member remain substantially the same distance from the tensioning device, causing the first and second portions of each elongate member to become closer to one another, thereby narrowing the adjustable width component.

In another aspect, the present disclosure is directed to a sole system for an article of footwear. The sole system may include a chamber configured to contain pressurized fluid. The chamber may include a base portion and a plurality of peripheral subchambers extending upward from the base portion. The sole system may also include a mating component including a central portion and a plurality of peripheral portions extending substantially radially from the central portion of the mating component, wherein the peripheral portions of the mating component extend between the peripheral subchambers. Further, the sole system may include an adjustment system including a tensile member anchored to the peripheral portions of the mating component, and a tensioning device configured to apply tension to the tensile member and thereby alter one or more performance characteristics of the sole system by applying pressure to the peripheral subchambers between the peripheral portions of the mating component.

In another aspect, the present disclosure is directed to a sole system for an article of footwear. The sole system may include at least one support member having a top portion, a sidewall surface, and a through hole extending from a first opening in a first area of the sidewall surface to a second opening in a second area of the sidewall surface. The sole system may also include an adjustment system including a tensile member extending through the through hole of the support member, and a tensioning device configured to selectively alter one or more performance characteristics of the support member by adjusting tension in the tensile member.

The advantages and features of novelty characterizing aspects of the invention are pointed out with particularity in the appended claims. To gain an improved understanding of the advantages and features of novelty, however, reference may be made to the following descriptive matter and accompanying figures that describe and illustrate various configurations and concepts related to the invention.

FIGURE DESCRIPTIONS

The foregoing Summary and the following Detailed Description will be better understood when read in conjunction with the accompanying figures.

DETAILED DESCRIPTION

Figure 1:
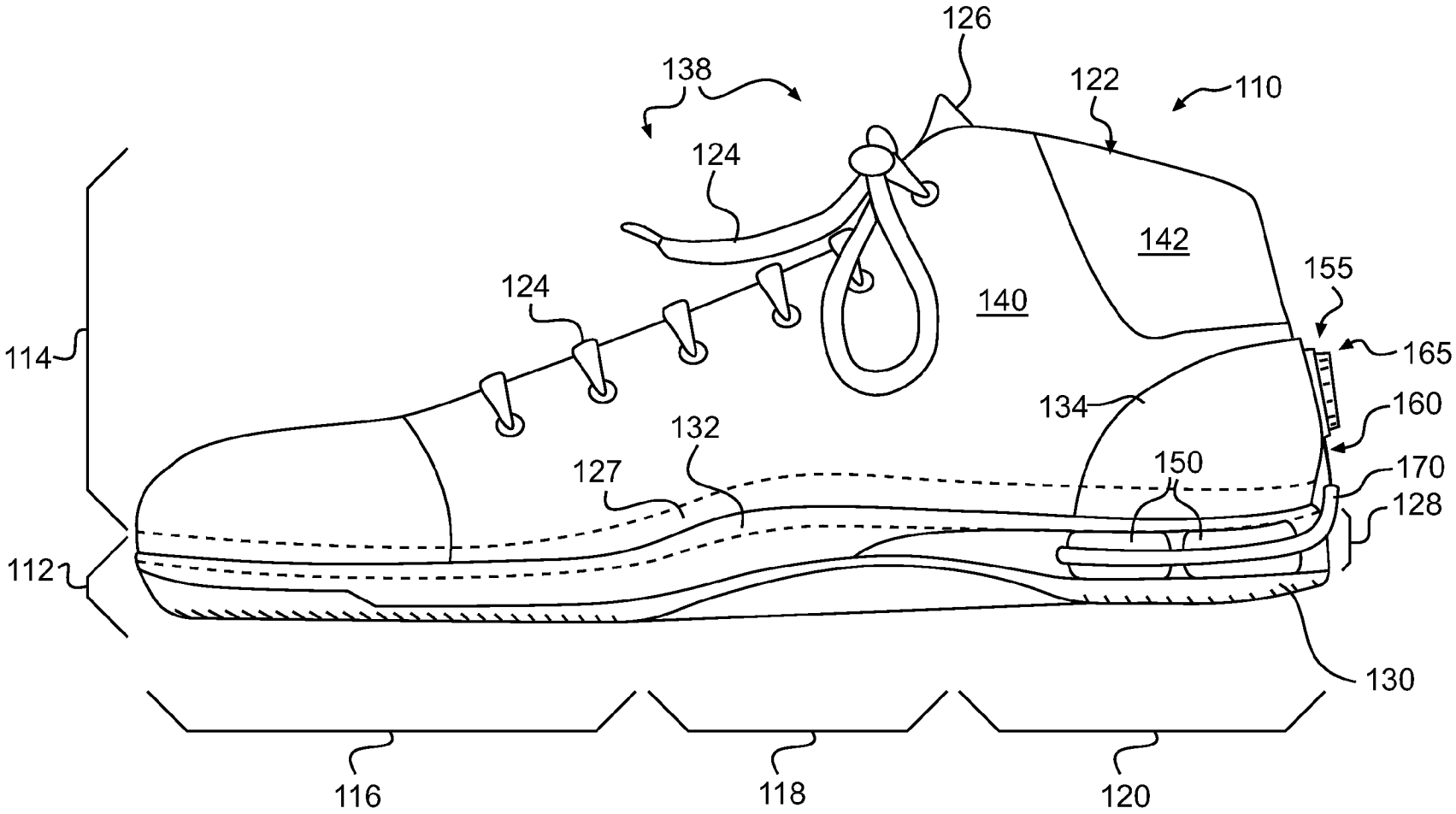
FIG. 1 is a side elevation view of an exemplary article of footwear having a midsole adjustment system.

The following discussion and accompanying figures disclose systems and methods for manufacturing an article of footwear. Concepts associated with the disclosed systems and methods may be applied to a variety of footwear types, including athletic shoes, dress shoes, casual shoes, or any other type of footwear.

For consistency and convenience, directional adjectives are employed throughout this detailed description corresponding to the illustrated embodiments. The term "longitudinal," as used throughout this detailed description and in the claims, refers to a direction extending a length of an article of footwear, that is, extending from a forefoot portion to a heel portion. The term "forward" is used to refer to the general direction in which the toes of a foot point, and the term "rearward" is used to refer to the opposite direction, i.e., the direction in which the heel of the foot is facing.

The term "lateral direction," as used throughout this detailed description and in the claims, refers to a side-to-side direction extending a width of the footwear. In other words, the lateral direction may extend between a medial side and a lateral side of an article of footwear, with the lateral side of the article of footwear being the surface that faces away from the other foot, and the medial side being the surface that faces toward the other foot.

The term "horizontal," as used throughout this detailed description and in the claims, refers to any direction substantially parallel with the ground, including the longitudinal direction, the lateral direction, and all directions in between. Similarly, the term "side," as used in this specification and in the claims, refers to any portion of a component facing generally in a lateral, medial, forward, and/or rearward direction, as opposed to an upward or downward direction.

The term "vertical," as used throughout this detailed description and in the claims, refers to a direction generally perpendicular to both the lateral and longitudinal directions. For example, in cases where a sole is planted flat on a ground surface, the vertical direction may extend from the ground surface upward. The term "upward" refers to the vertical direction heading away from a ground surface, while the term "downward" refers to the vertical direction heading towards the ground surface. Similarly, the terms "top," "upper," and other similar terms refer to the portion of an object substantially furthest from the ground in a vertical direction, and the terms "bottom," "lower," and other similar terms refer to the portion of an object substantially closest to the ground in a vertical direction.

For purposes of this disclosure, the foregoing directional terms, when used in reference to an article of footwear, shall refer to the article of footwear when sitting in an upright position, with the sole facing groundward, that is, as it would be positioned when worn by a wearer standing on a substantially level surface. Further, it will be understood that each of these directional terms may be applied to, not only a complete article of footwear, but also to individual components of an article of footwear.

In addition, for purposes of this disclosure, the term "fixedly attached" shall refer to two components joined in a manner such that the components may not be readily separated (for example, without destroying one or both of the components). Exemplary modalities of fixed attachment may include joining with permanent adhesive, rivets, stitches, nails, staples, welding or other thermal bonding, and/or other joining techniques. In addition, two components may be "fixedly attached" by virtue of being integrally formed, for example, in a molding process.

Footwear Structure

FIG. 1 depicts an article of footwear 110. The configuration of an article of footwear may vary significantly according to the type of activity for which the article of footwear is anticipated to be used. For example, in some embodiments, footwear may be anticipated to be used for athletic activities, such as running, jogging, and participating in sports. In some embodiments, the article of footwear may be configured for casual wear, such as running errands, attending school, or participating in a social event. In addition, the configuration of an article of footwear may vary significantly according to one or more types of ground surfaces on which the footwear may be used. For example, the footwear may be configured to have certain features and/or attributes depending on whether the footwear is anticipated to be used on natural outdoor surfaces, such as natural turf (e.g., grass), synthetic turf, dirt, snow; synthetic outdoor surfaces, such as rubber running tracks; or indoor surfaces, such as hardwood flooring/courts, rubber floors; and any other type of surface.

Footwear 110 is depicted in FIG. 1 as a high top sneaker, suitable for wear playing basketball, for example. However, the disclosed manufacturing apparatuses and methods may be applicable for manufacturing any type of footwear, including other types of athletic shoes, such as running shoes or cleated shoes; dress shoes, such as oxfords or loafers; casual shoes; or any other type of footwear.

As shown in FIG. 1, footwear 110 may include a sole structure 112 and an upper 114. For reference purposes, footwear 110 may be divided into three general regions: a forefoot region 116, a midfoot region 118, and a heel region 120. Forefoot region 116 generally includes portions of footwear 110 corresponding with the toes and the joints connecting the metatarsals with the phalanges. Midfoot region 118 generally includes portions of footwear 110 corresponding with an arch area of the foot. Heel region 120 generally corresponds with rear portions of the foot, including the calcaneus bone. Regions 116, 118, and 120 are not intended to demarcate precise areas of footwear 110. Rather, regions 116, 118, and 120 are intended to represent general relative areas of footwear 110 to aid in the following discussion. Since sole structure 112 and upper 114 both span substantially the entire length of footwear 110, the terms forefoot region 116, midfoot region 118, and heel region 120 apply not only to footwear 110 in general, but also to sole structure 112 and upper 114, as well as the individual elements of sole structure 112 and upper 114.

As shown in FIG. 1, upper 114 may include an ankle opening 122 in heel region 120 provides access to the interior void or cavity configured to receive a foot. In addition, upper 114 may include a lace 124, which may be utilized to modify the dimensions of the interior void, thereby securing the foot within the interior void and facilitating entry and removal of the foot from the interior void. Lace 124 may extend through apertures in upper 120, and a tongue portion 126 of upper 114 may extend between the interior void and lace 124. Upper 114 may alternatively implement any of a variety of other configurations, materials, and/or closure mechanisms. For example, upper 114 may include sock-like liners instead of a more traditional tongue; alternative closure mechanisms, such as hook and loop fasteners (for example, straps), buckles, clasps, cinches, or any other arrangement for securing a foot within the void defined by upper 114.

An upper of an article of footwear may be formed of one or more panels. In embodiments that combine two or more panels, the panels may be fixedly attached to one another. For example, upper panels may be attached to one another using stitching, adhesive, welding, and/or any other suitable attachment technique.

As shown in FIG. 1, upper 114 may include one or more upper panels 138. For example, in some embodiments, upper 114 may be made from a single panel. In other embodiments, upper 114 may be formed of multiple panels. For example, upper 114 may include a first upper panel 140 and a second upper panel 142. The shape and size of upper panels 138 may have any suitable form, and those skilled in the art will recognize various possible shapes and sizes for upper panels 138 other than those shown in FIG. 1.

Upper 114 may be formed out of any suitable materials. For example, upper panels 138 may be formed of such materials as leather, textiles, canvas, foam, rubber, polyurethane, vinyl, nylon, synthetic leathers, and/or any other suitable material. In some cases, footwear 110 may be formed out of multiple panels in order to facilitate assembly of footwear 110. In some embodiments, multiple panels may be used for upper 114 in order to enable different materials to be used in different parts of upper 114. Different materials may be chosen for different panels of footwear 110 based on factors such as strength, durability, wear-resistance, flexibility, breathability, elasticity, and comfort.

Sole structure 112 may be fixedly attached to upper 114 (for example, with adhesive, stitching, welding, and/or other suitable techniques) and may have a configuration that extends between upper 114 and the ground. Sole structure 112 may include provisions for attenuating ground reaction forces (that is, cushioning the foot). In addition, sole structure 112 may be configured to provide traction, impart stability, and/or limit various foot motions, such as pronation, supination, and/or other motions.

In some embodiments, sole structure 112 may include multiple components, which may individually and/or collectively provide footwear 110 with a number of attributes, such as support, rigidity, flexibility, stability, cushioning, comfort, reduced weight, and/or other attributes. In some embodiments, sole structure 112 may include an insole 127, a midsole 128, and a ground engaging sole component 130, as shown in FIG. 1. In some embodiments, midsole 128 may include a support plate 132. Insole 127 and support plate 132 are shown in broken lines in order to illustrate hidden boundaries of these components, not visible from the exterior of footwear 110. In some cases, one or more of these components of sole structure 112 may be omitted. Further, footwear 110 may also include a heel counter 134 affixed to or incorporated within upper 114.

Insole 127 may be disposed in the void defined by upper 114. Insole 127 may extend through each of regions 116, 118, and 120 and between the lateral and medial sides of footwear 110. Insole 127 may be formed of a deformable (for example, compressible) material, such as polyurethane foams, or other polymer foam materials. Accordingly, insole 127 may, by virtue of its compressibility, provide cushioning, and may also conform to the foot in order to provide comfort, support, and stability.

In some embodiments, insole 127 may be removable from footwear 110, for example, for replacement or washing. In other embodiments, insole 127 may be integrally formed with the footbed of upper 114. In other embodiments, insole 127 may be fixedly attached within footwear 110, for example, via permanent adhesive, welding, stitching, and/or another suitable technique. In some embodiments of footwear 110, upper 114 may include a bottom portion defining a lower aspect of the void formed by upper 114. Therefore, in such embodiments, insole 127 may be disposed above the bottom portion of upper 114, inside the void formed by upper 114. In other embodiments, upper 14 may not extend fully beneath insole 127, and thus, in such embodiments, insole 127 may rest atop midsole 128 (or sole component 30 in embodiments that do not include a midsole).

Footwear 110 is depicted in FIG. 1 as having a midsole 128. The general location of midsole 128 has been depicted in FIG. 1 as it may be incorporated into any of a variety of types of footwear. Midsole 128 may be fixedly attached to a lower area of upper 114 (for example, through stitching, adhesive bonding, thermal bonding (for example, welding), and/or other techniques), or may be integral with upper 114. Midsole 128 may extend through each of regions 116, 118, and 120 and between the lateral and medial sides of footwear 110.

In some embodiments, portions of midsole 128 may be exposed around the periphery of footwear 110, as shown in FIG. 1. For example, one or more support members 150. As shown in FIG. 1, support members 150 may, for example, be embodied as substantially cylindrical columns configured to provide cushioning and stability. In other embodiments, midsole 128 may be completely covered by other elements, such as material layers of upper 114.

Midsole 128 may be formed from any suitable material having the properties described above, according to the activity for which footwear 110 is intended. In some embodiments, midsole 128 may include a foamed polymer material, such as polyurethane (PU), ethyl vinyl acetate (EVA), or any other suitable material that operates to attenuate ground reaction forces as sole structure 112 contacts the ground during walking, running, or other ambulatory activities.

In some embodiments, a midsole may include, in addition (or as an alternative) to cushioning components, such as support members 150 discussed above, features that provide support and/or rigidity. In some embodiments, such features may include a support plate that extends at least part of the length of footwear 110. For example, as shown in FIG. 1, midsole 128 may include support plate 132. In some embodiments, support plate 132 may extend a portion of the length of footwear 110. In other embodiments, support plate 132 may extend substantially the entire length of footwear 110, as shown in FIG. 1.

Support plate 132 may be a substantially flat, plate-like platform. Support plate 132, although relatively flat, may include various anatomical contours, such as a relatively rounded longitudinal profile, a heel portion that is higher than the forefoot portion, a higher arch support region, and other anatomical features.

Support plate 132 may be formed of a relatively rigid plastic, carbon fiber, or other such material, in order to maintain a substantially flat surface upon which the forces applied by a foot during ambulatory activities may be distributed. Support plate 132 may also provide torsional stiffness to sole structure 112, in order to provide stability and responsiveness.

A ground-engaging sole component may include features that provide traction, grip, stability, support, and/or cushioning. For example, a sole component may have ground-engaging members, such as treads, cleats, or other patterned or randomly positioned structural elements. A sole component may also be formed of a material having properties suitable to provide grip and traction on the surface upon which the footwear is anticipated to be used. For example, a sole component configured for use on soft surfaces, may be formed of a relatively hard material, such as hard plastic. For instance, cleated footwear, such as soccer shoes, configured for use on soft grass may include a sole component made of hard plastic, having relatively rigid ground engaging members (cleats). Alternatively, a sole component configured for use on hard surfaces, such as hardwood, may be formed of a relatively soft material. For example, a basketball shoe configured for use on indoor hardwood courts may include a sole component formed of a relatively soft rubber material.

Ground-engaging sole components may be formed of suitable materials for achieving the desired performance attributes. Sole components may be formed of any suitable polymer, composite, and/or metal alloy materials. Exemplary such materials may include thermoplastic and thermoset polyurethane (TPU), polyester, nylon, polyether block amide, alloys of polyurethane and acrylonitrile butadiene styrene, carbon fiber, poly-paraphenylene terephthalamide (paraaramid fibers, e.g., Kevlar®), titanium alloys, and/or aluminum alloys. In some embodiments, sole components may be formed of a composite of two or more materials, such as carbon-fiber and poly-paraphenylene terephthalamide. In some embodiments, these two materials may be disposed in different portions of the sole component. Alternatively, or additionally, carbon fibers and polyparaphenylene terephthalamide fibers may be woven together in the same fabric, which may be laminated to form the sole component. Other suitable materials and composites will be recognized by those having skill in the art.

The sole component may be formed by any suitable process. For example, in some embodiments, the sole component may be formed by molding. In addition, in some embodiments, various elements of the sole component may be formed separately and then joined in a subsequent process. Those having ordinary skill in the art will recognize other suitable processes for making the sole components discussed in this disclosure. As shown in FIG. 1, sole component 130 may be disposed at a bottom portion of footwear 110 and may be fixedly attached to midsole 128.

In addition, in some embodiments, footwear may include other footwear components, such as a heel counter. In some cases, components such as heel counters may, themselves, be upper panels. In other cases, heel counters, and other such components, may be separate components added to an upper.

In some embodiments, an article of footwear may include a heel counter to provide support and stability to the heel and ankle regions of the foot. In some embodiments, the heel counter may be disposed on an outside portion of the upper. In other embodiments, the heel counter may be disposed in between layers of the upper. The heel counter may be formed of a relatively rigid material, configured to stiffen the rear section of an article of footwear, including the heel region. In some embodiments, the heel counter may include a U-shaped structure configured to wrap around the lateral, rear, and medial portions of the heel region of the footwear. In some embodiments, the heel counter may also include a bottom portion configured to be disposed under the heel region of the upper.

As shown in FIG. 1, footwear 110 may include heel counter 134. Heel counter 134 may be fixedly attached to upper 114 in heel region 120 of footwear 110. For example, heel counter 134 may wrap around the lateral, rear, and medial sides of heel region 120. Heel counter 134 may be formed of a suitably rigid material, such as hard plastic, carbon fiber, stiff cardboard, or any other type of relatively rigid material. In some embodiments, heel counter 134 may be attached to an exterior of upper 114 with adhesive, stitching, welding, or another suitable fastening technique. Heel counter 134 may have a pre-formed shape, or may be shaped/molded in conjunction with its attachment to upper 114, as will be discussed in greater detail below.

Midsole Adjustment System

Midsole 128 of sole structure 112 may include one or more support members 150. Support members 150 may include substantially cylindrical support columns disposed, for example, in heel region 120 of footwear 110. In some embodiments, support members 150 may have other configurations and/or shapes. For example, in some embodiments, support members may have a rectangular, oval, square, or other cross-sectional shape. In addition, sidewalls of support members may be curved, for example in either a convex (bulged) manner, as shown in FIG. 1, or a concave (hourglass) manner. Support members 150, as part of midsole 128, may provide cushioning and stability to footwear 110. Accordingly, support members 150 may be formed of any suitable material, such as rubber, foam, plastics, and any other suitable materials. In some embodiments, support members 150 may be hollow, whereas, in other embodiments, support members 150 may be solid. In still other embodiments, support members 150 may contain a fluid medium, such as a liquid, gel, or gas. Support members 150 may be compressible to absorb and control ground reaction forces, and may be resilient such that, when any loads applied to support members 150 are released, support members 150 may return to an uncompressed/undeformed shape.

Various wearers may have different preferences as to the performance characteristics of their footwear. For example, when choosing footwear, wearers may consider characteristics such as weight, fitment, comfort, and traction. In some cases, one wearer may favor lightweight at the expense of fit, whereas another wearer may favor traction over lightweight. Similarly, wearers may also consider characteristics such as cushioning, stability, responsiveness, and control. Like the characteristics above, these characteristics are also weighed differently by different wearers. In some cases, differences in the physical characteristics of the wearers and/or differences in the activities performed by the wearers while wearing the footwear may influence the wearers' preferences. For example, heavier wearers may prefer a relatively softer midsole that offers more cushioning, whereas a lighter wearer may prefer a relatively harder midsole that is more responsive. Similarly, a wearer that is performing a power intensive exercise, such as a football lineman, may want a stiffer sole structure to provide support and stability, whereas a wearer that is performing an exercise that involves more speed and quickness, such as a football wide receiver, may prefer lightweight footwear, with high levels of responsiveness. In addition, two similarly sized athletes performing the same activity may have different preferences regarding footwear characteristics. Further, athletes may have conditions (for example, injuries) that influence their footwear selection. For example, two similarly sized athletes may play the same sport, but one has an injured knee and, therefore, favors footwear with more cushioning.

The performance characteristics of footwear may be tailored based on shoe size. That is, each size of footwear may be provided with performance characteristics that are based on the average weight of wearers of that size. However, not all wearers of that size may be the same weight. Further, many other factors discussed above may lead to wearers having varied preferences as to the performance characteristics of footwear. Accordingly, footwear that is mass produced may not be tuned precisely to the preferences of each wearer when the footwear leaves the factory. Accordingly, it may be desirable to have a way to alter the performance characteristics of a midsole via a wearer adjustment built into (or onto) the footwear.

The present disclosure is directed to adjustment systems for adjusting performance characteristics of midsole components. FIG. 1 illustrates an exemplary midsole adjustment system 155. Adjustment system 155 may include, in addition to support members 150, a tensile member 160, which may at least partially surround support members 150. Tensile member 160 may serve as a cinch, and thus, tensile member 160 may be tightened (cinched) around support members 150 to alter the performance characteristics of midsole 128 by altering one or more properties of support members 150. For example, tightening tensile member 160 may squeeze support members 150, which may alter the shape of support members 150, such as by increasing the height of support members 150 and/or decreasing the width of support members 150, as discussed in greater detail below. Further, tightening tensile member 160 about support members 150 may alter the vertical compliance or compressibility and/or the horizontal stiffness of support members 150, as well as other properties of support members 150. In some configurations, multiple tensile members may be associate with a support member (for example in a parallel fashion), which may increase the surface area over which the compression is applied to the support member by the tensile members.

In some embodiments, support members 150 may be hollow, gas-filled chambers formed, for example, by bladders. In such embodiments, tightening tensile member 160 may alter the compressibility, or other performance characteristics, of support members 150. For example, tightening tensile member 160 may increase the pressure of the gas within the chambers, thus altering the compressibility, support, rigidity, shape, height, and/or other characteristics of support members 150. In some embodiments, support members 150 may be filled with gases at substantially atmospheric pressure. Bladders filled with gases at substantially atmospheric pressure may be made with significantly less cost than more highly pressurized chambers. However, atmospheric pressure is typically not suitable for supporting the weight of a wearer. Accordingly, tightening tensile member 160 may pressurize support members 150 to a supportive pressure, and such pressure may be adjusted by the wearer according to their performance preferences.

Support member chambers may be formed from a polymer or other bladder material that provides a sealed barrier for enclosing a fluid. As noted above, the bladder material may be transparent. A wide range of polymer materials may be utilized for such chambers. In selecting materials for chambers, engineering properties of the material (e.g., tensile strength, stretch properties, fatigue characteristics, dynamic modulus, and loss tangent) as well as the ability of the material to prevent the diffusion of the fluid contained by the chambers may be considered. When formed of thermoplastic urethane, for example, the outer barrier of the chambers may have a thickness of approximately 1.0 millimeter, but the thickness may range from 0.25 to 2.0 millimeters or more, for example.

In addition to thermoplastic urethane, examples of polymer materials that may be suitable for support member chambers include polyurethane, polyester, polyester polyurethane, and polyether polyurethane. Chambers may also be formed from a material that includes alternating layers of thermoplastic polyurethane and ethylene-vinyl alcohol copolymer, as disclosed in U.S. Pat. Nos. 5,713,141 and 5,952,065 to Mitchell, et al. A variation upon this material may also be utilized, wherein a center layer is formed of ethylene-vinyl alcohol copolymer, layers adjacent to the center layer are formed of thermoplastic polyurethane, and outer layers are formed of a regrind material of thermoplastic polyurethane and ethylene-vinyl alcohol copolymer. Another suitable material for chambers is a flexible microlayer membrane that includes alternating layers of a gas barrier material and an elastomeric material, as disclosed in U.S. Pat. Nos. 6,082,025 and 6,127,026 to Bonk, et al. Additional suitable materials are disclosed in U.S. Pat. Nos. 4,183,156 and 4,219,945 to Rudy. Further suitable materials include thermoplastic films containing a crystalline material, as disclosed in U.S. Pat. Nos. 4,936,029 and 5,042,176 to Rudy, and polyurethane including a polyester polyol, as disclosed in U.S. Pat. Nos. 6,013,340; 6,203,868; and 6,321,465 to Bonk, et al. The patents listed in this paragraph are incorporated herein by reference in their entirety.

The fluid within chambers may range in pressure from zero to three-hundred-fifty kilopascals (i.e., approximately fifty-one pounds per square inch) or more. In some configurations of sole structure 30, a suitable pressure for the fluid may be a substantially ambient pressure. That is, the pressure of the fluid may be within five kilopascals of the ambient pressure of the atmospheric air surrounding footwear 10. The pressure of fluid within chambers may be selected to provide desirable performance attributes. For example, higher pressures may provide a more responsive cushioning element, whereas lower pressures may provide more ground force attenuation (a softer cushion). The pressure of fluid within chambers may be selected to work in concert with other cushioning elements of footwear 10, such as foam members and/or an insole (not shown).

In some configurations, support member chambers may be inflated with substantially pure nitrogen. Such an inflation gas promotes maintenance of the pressure within chambers through diffusion pumping, whereby the deficiency of other gases (besides nitrogen), such as oxygen, within chambers biases the system for inward diffusion of such gasses into chambers. Further, bladder materials, such as those discussed above, may be substantially impermeable to nitrogen, thus preventing the escape of the nitrogen from chambers.

In some configurations, relatively small amounts of other gases, such as oxygen or a mixture of gasses, such as air, may be added to the nitrogen occupying most of the volume within support member chambers. In addition to air and nitrogen, the fluid contained by chambers may include octafluorapropane or be any of the gasses disclosed in U.S. Pat. No. 4,340,626 to Rudy, such as hexafluoroethane and sulfur hexafluoride, for example. In some configurations, chamber 50 may incorporate a valve that permits the individual to adjust the pressure of the fluid. In other configurations, chambers may be incorporated into a fluid system, as disclosed in U.S. Pat. No. 7,210,249 to Passke, et al., as a pump chamber or a pressure chamber. In order to pressurize chambers or portions of chambers, the general inflation methods disclosed in U.S. Patent Application Publication No. US 2009-0151195 (entitled "Method For Inflating A Fluid-Filled Chamber" and filed in the U.S. Patent and Trademark Office on 17 Dec. 2007), and U.S. Patent Application Publication No. US 2009-0151196 (entitled "Article Of Footwear Having A Sole Structure With A Fluid-Filled Chamber" and filed in the U.S. Patent and Trademark Office on 17 Dec. 2007), may be utilized. The patents and published patent applications listed in this paragraph are incorporated herein by reference in their entirety.

Upon inflation, chambers experience pressure that is evenly distributed to all portions of the inner surface of the bladder material from which the chamber is formed. Accordingly, the tendency is for chambers, when inflated, to take on an outwardly rounded shape. In order to maintain a relatively flat shape, that is, with the upper and lower surfaces of the chamber being relatively parallel to one another, one or more tensile members may be attached to the upper and lower surface, which may restrict the distance to which the chamber may be expanded by pressurized gases in a particular direction, such as the vertical direction. Exemplary tensile member configurations are described in U.S. Pat. No. 6,837,951, issued Jan. 4, 2005, and entitled "Method of Thermoforming a Bladder Structure," and U.S. patent application Ser. No. 13/571,749, filed Aug. 10, 2012, entitled "Methods for Manufacturing Fluid-Filled Chambers Incorporating Spacer Textile Materials," each of which is incorporated herein by reference in its entirety. Other tensile member configurations are also possible, and those having skill in the art will recognize alternative tensile member configurations that may be suitable for the support member structures described in the present disclosure.

Tensile member 160 may have any suitable construction. In some embodiments, tensile member 160 may include a wire, cable, rope, or other elongate, flexible (or semi-flexible) member. In some embodiments, tensile member 160 may be configured to contact support members 150 in a larger surface area. For example, in some configurations, tensile members 160 having relatively round cross-sectional shapes may have larger diameters. In some configurations, tensile member 160 may include a ribbon, strap, or other type of elongate structure having a relatively flat or flattened cross-sectional shape. In some configurations, tensile member 160 may be a wire or ribbon formed of a single filament. In other embodiments, tensile member 160 may be a cable, rope, or strap formed of multiple filaments, which may be either wound or woven together to form a single tensile member 160. In some embodiments, tensile member 160 may be relatively inelastic in tension. In other embodiments, tensile member 160 may have a certain amount of elasticity in tension. Relatively inelastic tensile members may facilitate more significant and/or precise changes in performance characteristics, while relatively elastic tensile members may enable more subtle changes in performance characteristics and/or may provide performance characteristics that include more compliance generally.

Since the performance characteristics of an adjustable midsole component are based on a combination of the characteristics of the support member and the tensile member surrounding it, tensile members and support members may be selected according to the desired combined effect. For example, relatively compressible support members may be paired with relatively inelastic tensile members, which may be used to substantially stiffen the relatively compressible support members. In other cases, a high level of compressibility may still be desired within the range of adjustments. In such cases, it may be desirable to pair a relatively compressible support member with a relatively elastic tensile member. Although tightening an elastic tensile member around a compressible support member may increase the stiffness and/or decrease the compressibility of the support member, the elasticity of the tensile member still allows deformation of the support member under loads, whereas an inelastic tensile member may provide a substantially strict limitation on the amount of deformation the support member is allowed to undergo, thereby creating a potentially higher level of variation in performance characteristics.

In addition to having various structural configurations, the tensile members may be formed of a variety of suitable materials in order to achieve the desired characteristics discussed above. For example, in some configurations, the tensile member may be a semi-flexible, mono-filament, metal wire. In other configurations, the tensile member may be a semi-flexible, multi-filament, metal cable. In other configurations, the tensile member may be formed of synthetic materials, such as polymers and composites. In some embodiments, mono-filament plastics, for example, similar to fishing line, may be utilized. In other embodiments, wound or woven synthetic materials, such as poly-paraphenylene terephthalamide (para-aramid fibers, e.g., Kevlar® may be utilized to form the tensile member.

In some embodiments, system 155 may include a wire housing 170, as shown in FIG. 1. Wire housing 170 may provide a smooth, clean, low friction environment in which tensile member 160 may slide. In addition, tubular wire housing enclosing at least part of tensile member 160 may be configured to maintain positioning of tensile member 160 and distribute forces applied to support member 150 by tensile member 160 by contacting support member 150 over a surface area that is larger than one half the circumference of tensile member 160. Details of wire housing design are well-known to artisans in the field of bicycle shifting and brake cables. Technologies, such as friction-reducing polytetrafluoroethylene (PTFE) inner coatings, that may be used in bicycle shifter and brake cable housings may also be applicable to the presently disclosed embodiments.

In addition, adjustment system 155 may include a tensioning device 165. Tensioning device 165 may include, for example, a dial-type device configured to wind tensile member 160, in order to shorten the amount of wire wrapped around support members 150, to thereby tighten tensile member 160, thus altering the performance characteristics of support members 150. Further details regarding exemplary tensioning devices, and exemplary adjustment systems in general, are provided below in reference other disclosed embodiments. The factors, considerations, and details discussed above with regard to FIG. 1, may also be applicable to the embodiments discussed below.

Figure 2:
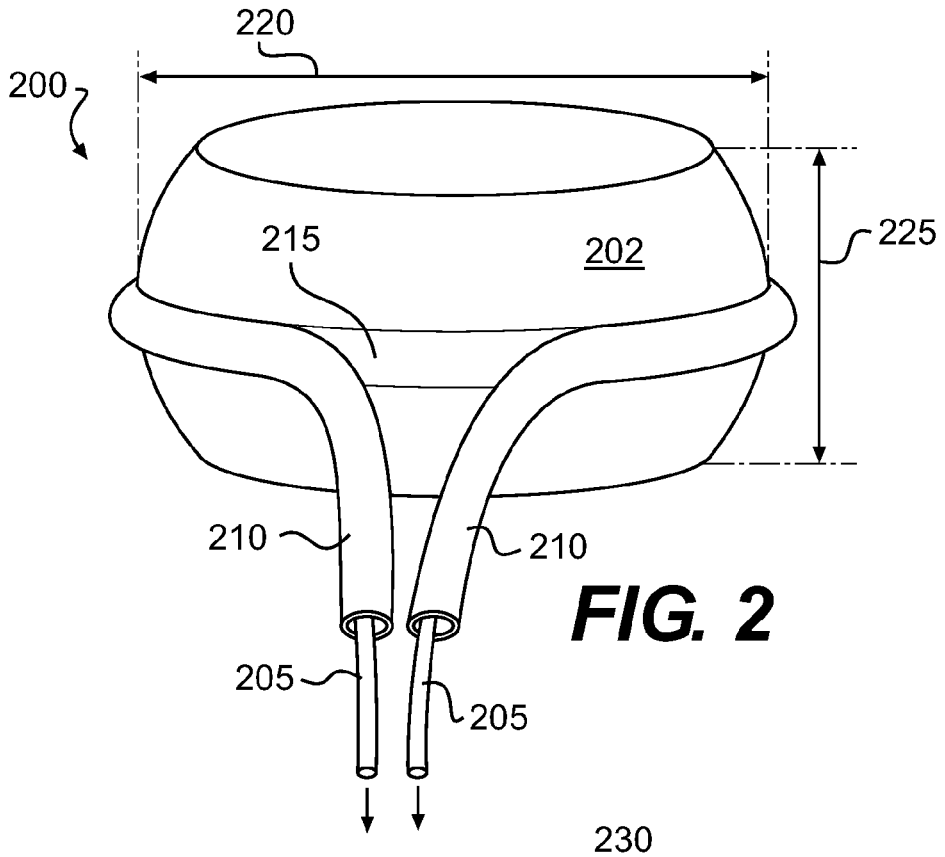
FIG. 2 is a perspective view of a midsole adjustment system for an article of footwear.
Figure 3:
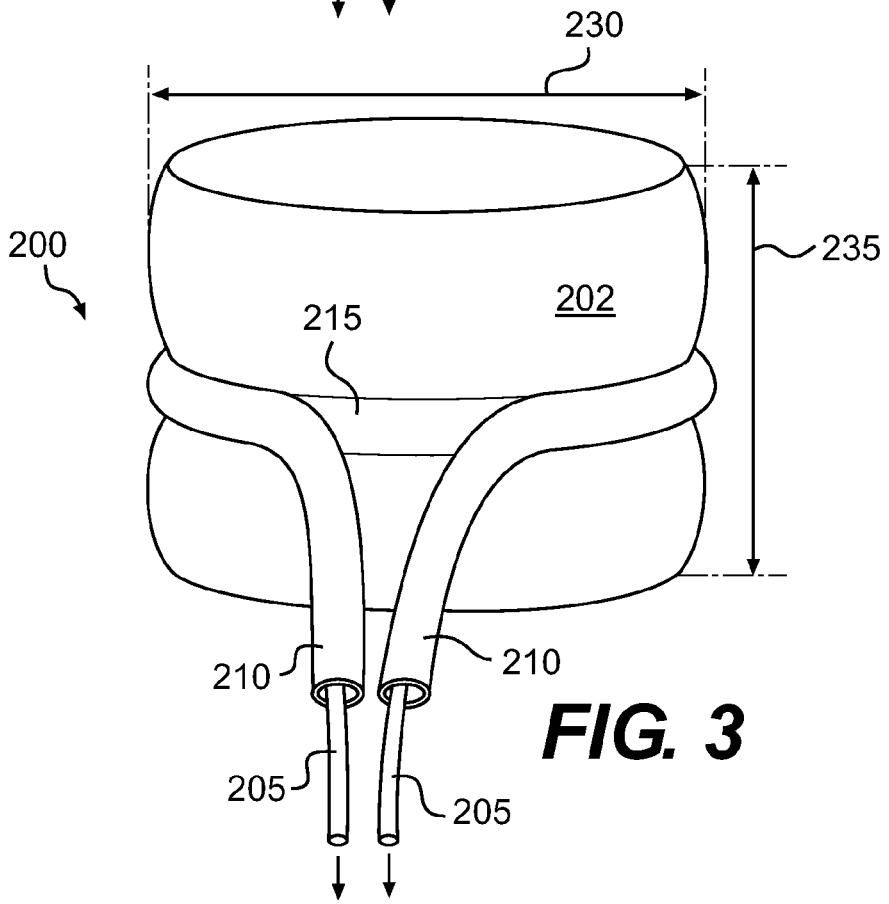
FIG. 3 is a perspective view corresponding with FIG. 2 and showing the midsole adjustment system in a deflected position.

FIGS. 2 and 3 illustrate the alteration in shape of a support member when squeezed by the tightening of a tensile member at least partially surrounding the support member. FIG. 2 shows a midsole adjustment system 200, including a support member 202. FIG. 2 shows support member 202 in an unloaded condition. In FIG. 2, support member 202 has a substantially convex shape. Adjustment system 200 may include a tensile member 205, which may be slidably disposed within a housing 210. Tensile member 205 and/or housing 210 may be disposed within an indentation, such as a groove 215 in support member 202, which may maintain the vertical placement of housing 210 and, therefore the vertical placement of tensile member 205, relative to support member 202. In the unloaded condition, support member 202 may have a first diameter 220, and a first height 225.

FIG. 3 illustrates the effect of tightening tensile member 205 on the shape of support member 202. Notably, under the radially inward force applied by tightening tensile member 205, support member 202 compresses radially to have a smaller second diameter 230, while increasing its vertical dimension to a second height 235. Support member 205 may be formed of a resilient material, as discussed above, and, accordingly, may return to its original shape when loads applied by tensile member 205 are released.

These changes in shape of support member 202 by tensile member 205 may be used to tailor footwear to a wearer. In some embodiments, this type of shape alteration of support member 202 may be utilized to slightly change the form of the footbed on which the wearer stands. For example, if support member 202 is mounted in a heel region of an article of footwear, the amount of heel raise may be varied according to the wearer's preference. In some cases, a heel height may be raised in an athletic shoe in order to alleviate or prevent symptoms of an injury. For example, it may be desirable to raise the heel of an athlete who has, or wishes to prevent, an Achilles tendon injury, or other type of injury that could be affected by the amount of ankle flexion in a person's gait. This type of shape alteration could also be used to provide a higher or lower footbed toward the medial or lateral side of the footwear. This may be utilized to treat or prevent injuries or conditions such as pronation and/or supination.

In some embodiments, footwear may be constructed such that tightening may not result in a significant increase in height of support member 202. In such embodiments, the more significant effect of the tightening may be to prevent the expansion in the radial direction caused by vertical loads that are applied to support member 202. By preventing or limiting radial expansion of support member 202 under vertical loads, the compressibility of support member 202 may be reduced. Thus, tightening tensile member 205 about support member 202 may be utilized to preload support member so it does not react as significantly (that is, it will not compress as much) under loads. Limiting the compressibility of support members may provide a less compliant, but more responsive midsole, which may be preferred by some wearers.

In addition, tightening tensile member 205 about support member 202 may also affect the lateral stiffness of support member 202. Under lateral loads (for example, that may result from an athlete cutting from side-to-side), support member 202 may be subjected to shear forces, which may cause the side profile of support member 202 to appear substantially like a parallelogram, as the top portion of support member 202 may translate more laterally (with the upper of the footwear) than a bottom portion of support member 202 (which is more closely affixed to the ground engaging sole component). The more of this shear strain that is allowed by support member 202, the less responsive an article of footwear will be to lateral loading, such as during cutting by an athlete. Accordingly, tensile member 205 may be tightened about support member 202 to increase the lateral stiffness of support member 202, thereby increasing the responsiveness of the article of footwear.

Exemplary Midsole Adjustment System Configurations

The following embodiments illustrate possible implementations of the concepts discussed above. For example, as discussed in greater detail below, the alterations in support member characteristics provided by tightening tensile members around support members may be implemented at various locations of footwear sole structure (forefoot, heel, medial, and lateral). The following embodiments also illustrate exemplary implementations of tensioning devices to effectuate tensile member tightening.

Figure 4:
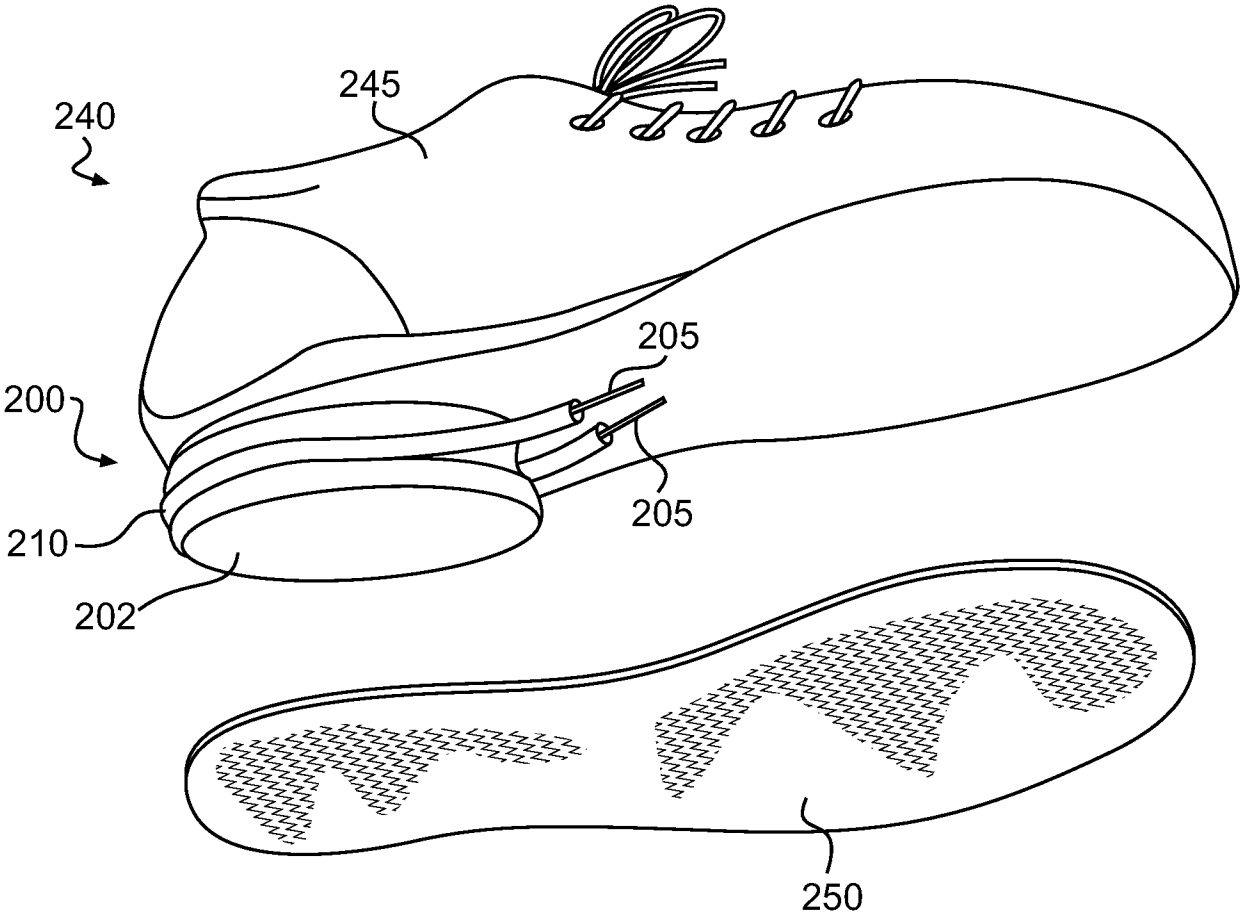
FIG. 4 is an exploded, perspective view of an exemplary article of footwear having a midsole adjustment system.

FIG. 4 illustrates an implementation of support member 202 as a single heel support member in an article of footwear 240. Footwear 240 may include an upper 245 configured to receive a foot of a wearer. In addition, footwear 240 may also include a ground-engaging sole component 250. FIG. is an exploded view, showing sole component 250 as separated from the bottom of footwear 240. Although not shown, a similar, large support member and associated adjustment system could also be incorporated into the forefoot region of footwear 240. A suitable tensioning device may be used with this embodiment. Exemplary such devices are discussed in detail below with regard to other embodiments. It will be understood that the details of such tensioning devices discussed below may be applicable to the embodiment shown in FIG. 4.

In some embodiments, a midsole adjustment system may include multiple support members substantially surrounded by a single tensile member. In such embodiments, the characteristics for all of the support members may be collectively altered by tensioning the single tensile member. In some embodiments, a similar configuration may utilize plural tensile members, wherein each tensile member substantially surrounds all of the support members. In some embodiments, some support members of the system may be surrounded by more than one tensile member, whereas other support members may be surrounded by only one tensile member. In this manner, some support members in the system may be adjusted more than others. This may be beneficial, for example, to adjust high impact support members, such as those at the far rear of the footwear, where initial footstrike may occur. Other various combinations of multiple tensile members and multiple support members are also envisaged, and will be appreciated by those having ordinary skill in the art.

Figure 5:
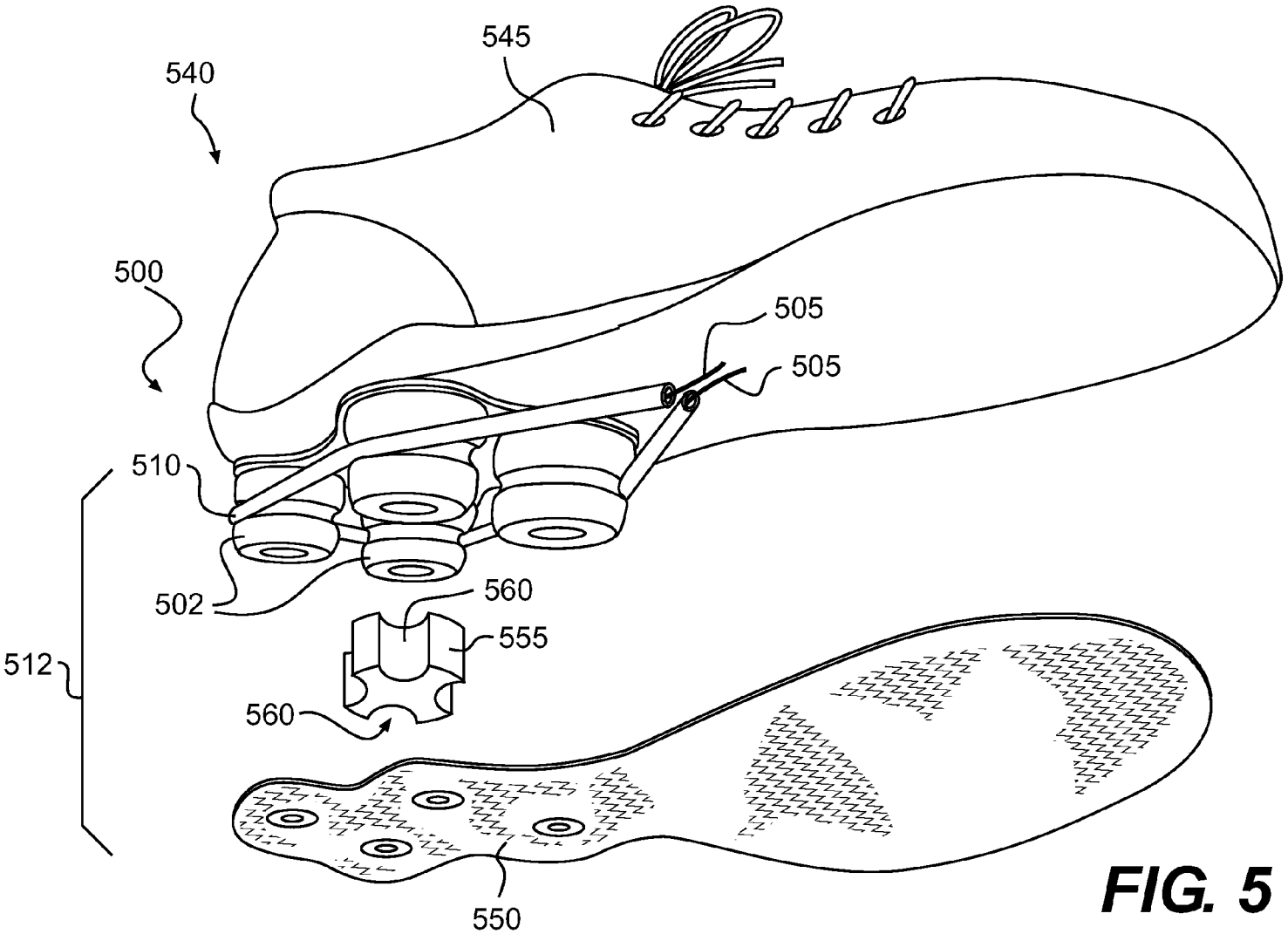
FIG. 5 is an exploded, perspective view of another exemplary article of footwear having a midsole adjustment system.

FIG. 5 illustrates an article of footwear 540, including an upper 545 and a sole structure 512. Sole structure may include a ground engaging sole component 550. In addition, footwear 540 may include a midsole adjustment system 500. System 500 may include multiple support members 502. Further, system 500 may include a tensile member 505, which may be disposed within a housing 510. In order to resist the tendency of support members 502 deflecting toward a center of the arrangement upon application of tension to tensile member 505, system 500 may include a spacer 555.

Spacer 555 may be disposed between support members 502. Exemplary placement for such a spacer is illustrated in more detail with regard to other embodiments. Spacer 555 may be configured to buttress support members 502 against forces applied to support members by tensile member 505. Accordingly, spacer 555 may be configured to cradle portions of support members 502. For example, spacer 555 may include one or more indentations 560 configured to receive support members 502. In some embodiments, spacer 555 may be formed of a relatively compressible/compliant material. In other embodiments, spacer 555 may be formed of a substantially rigid material. A substantially rigid spacer may be configured to resist compression, thereby causing a substantial majority of the deformation of support members 502 to be elongation in the direction substantially perpendicular to the radial direction in which compression forces are applied by tensile member 505.

The rigidity/compressibility of spacer 555 may be a significant factor in determining how much adjustment to performance properties of support members 502 will be created by the tensioning of tensile members 505. The more rigid the spacer, the more adjustment (stiffness) will be created by tensioning tensile members about the support members. In some embodiments, spacer 555 may have a horizontal compliance that is substantially different from the horizontal compliance of support members 502. In other embodiments, spacer 555 may have a horizontal compliance that is substantially the same as the horizontal compliance of support members 502.

Figure 6:
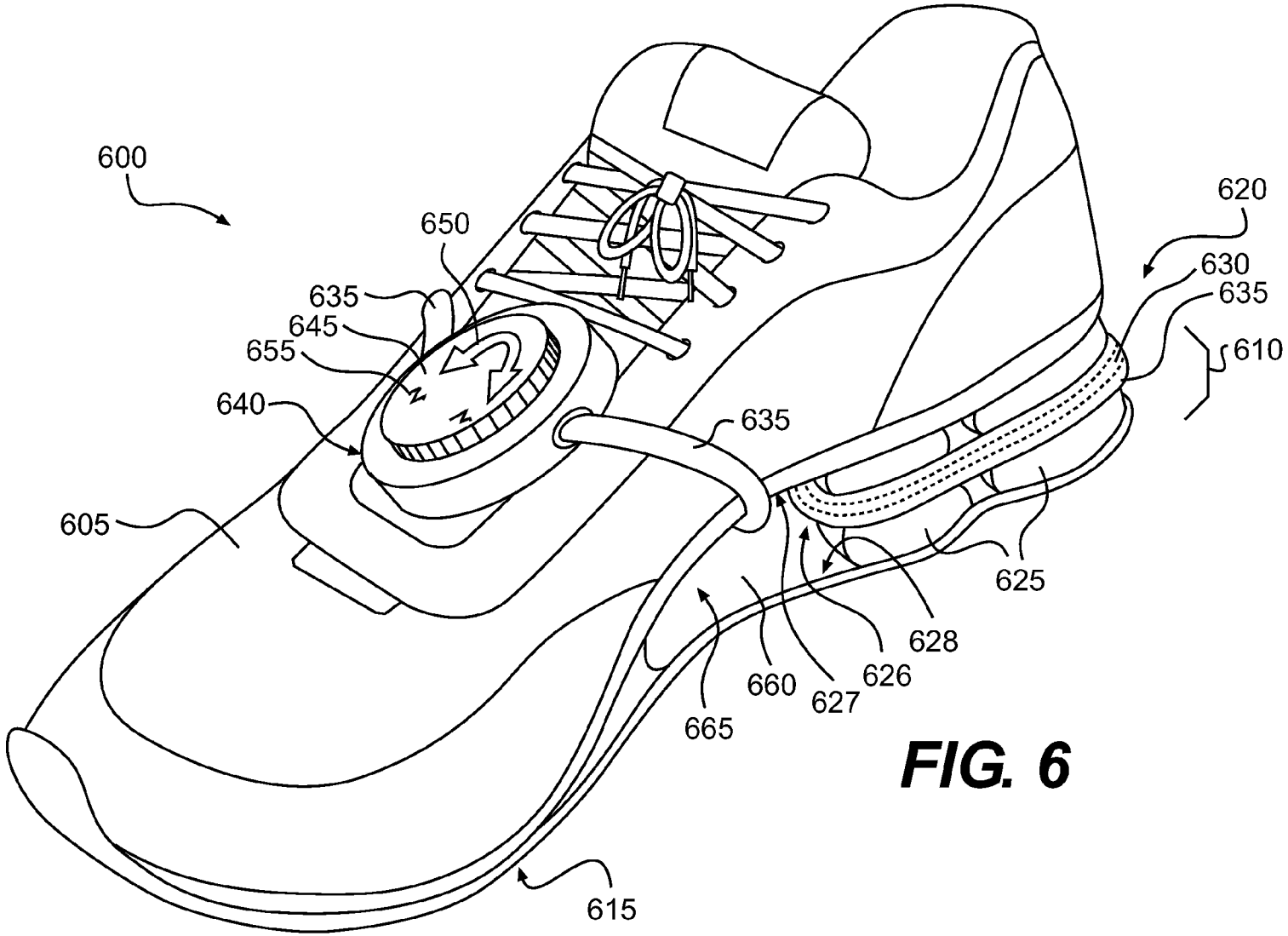
FIG. 6 is a perspective view of an exemplary article of footwear having a midsole adjustment system.

FIG. 6 illustrates an additional embodiment including a midsole adjustment system in a heel region of an article of footwear. As shown in FIG. 6, an article of footwear 600 may include an upper 605 and a sole structure 610. Sole structure may include a ground engaging sole component 615 and a midsole adjustment system 620.

In some embodiments, adjustment system 620 may include a plurality of support members 625 in a heel region of footwear 600. In addition, system 620 may include a tensile member 630 substantially surrounding support members 625. Tensile member 630 may be slidably disposed in a wire housing 635. In some embodiments, as shown in FIG. 6, sole structure 610 may include a void 626 defined by a first surface 627 and a second surface 628 opposite first surface 627. In some embodiments, support members 625 may be located within void 626. For example, as shown in FIG. 6, support members 625 may be secured to first surface 627 and second surface 628. In addition, wire member 630 may extend at least partially around support members 625 at a location between first surface 627 and second surface 628.

Tensile member 630 may be associated with a tensioning device 640. In some embodiments, tensioning device 640 may include a dial 645, which may be rotated in order to tighten tensile member 630. In some embodiments, dial 645 may be depressed and then twisted in order to apply tension. The internals of tensioning device 640 may include a ratcheting mechanism, so that incremental increases in tension may be applied, without slippage of tensile member 630 that can cause unwanted loosening. In some embodiments, dial 645 may be pressed or pulled upward in order to release the tension on tensile member 630. In other embodiments, tensioning device 640 may be rotated in an opposite direction from the tightening direction in order to loosen tensile member 630. Tensioning device 640 may include an arrow 650, which may be single-headed or double-headed, in order to indicate the direction in which dial 645 may be turned in order to tension tensile member 630. In some embodiments, dial 645 may also include indicia 655, providing, for example, instructions regarding usage of dial 645 to tighten and/or loosen tensile member 630.

Dial-type wire lacing systems are known in the art. Exemplary such systems have been developed by Boa Technology Inc. Additional details regarding exemplary Boa lacing systems may be found in U.S. Pat. Nos. 5,934,599; 6,202,953; and 6,689,558, all of which are incorporated herein by reference. The present disclosure does not, however, propose implementing dial-type wire tensioning systems for lacing an article of footwear. Rather, the present disclosure proposes to implement such tensioning devices for altering the performance characteristics of midsole components of an article of footwear.

In some embodiments, tensioning device 640 may be located on an exterior of footwear 600. For example, as shown in FIG. 6, tensioning device 640 may be located on an instep region of footwear 600. For example, tensioning device 640 may be disposed on or near conventional shoe laces. In some embodiments, however, alternative closure systems may be used, such as straps, hook and loop fasteners, and any other suitable closure system. In addition to providing tension around support members 625, in some embodiments, placement of tensioning device 640 in the instep region may have the additional benefit of tightening the top of footwear 600 against the wearer's instep. In some embodiments, however, use of wire housing and housing ferrules may limit the degree to which this tension is transmitted to the instep region via housing 635. As such, variations in the components of footwear 600 may affect the degree to which wire 630 and tensioning device 640 may be used to tighten the upper against the foot.

In order to wrap tensile member 630 substantially around support members 625, and provide an improved angle of tension, housing 635 may be routed in a lateral direction, in front of support members 625 before proceeding up around upper 605 to the instep region. In this wire routing configuration, tensile member 630 and housing 635 may crisscross in front of support members 625, in an opening 660 provided in an arch region 665 of footwear 600. Accordingly, tensile member 630 may extend from tensioning device 640 disposed on the instep of footwear 600 around support members 625 disposed in the heel region of footwear 600 and may crisscross under arch region 665 of footwear 600 between tensioning device 640 and support members 625 in arch region 665.

Figure 7:
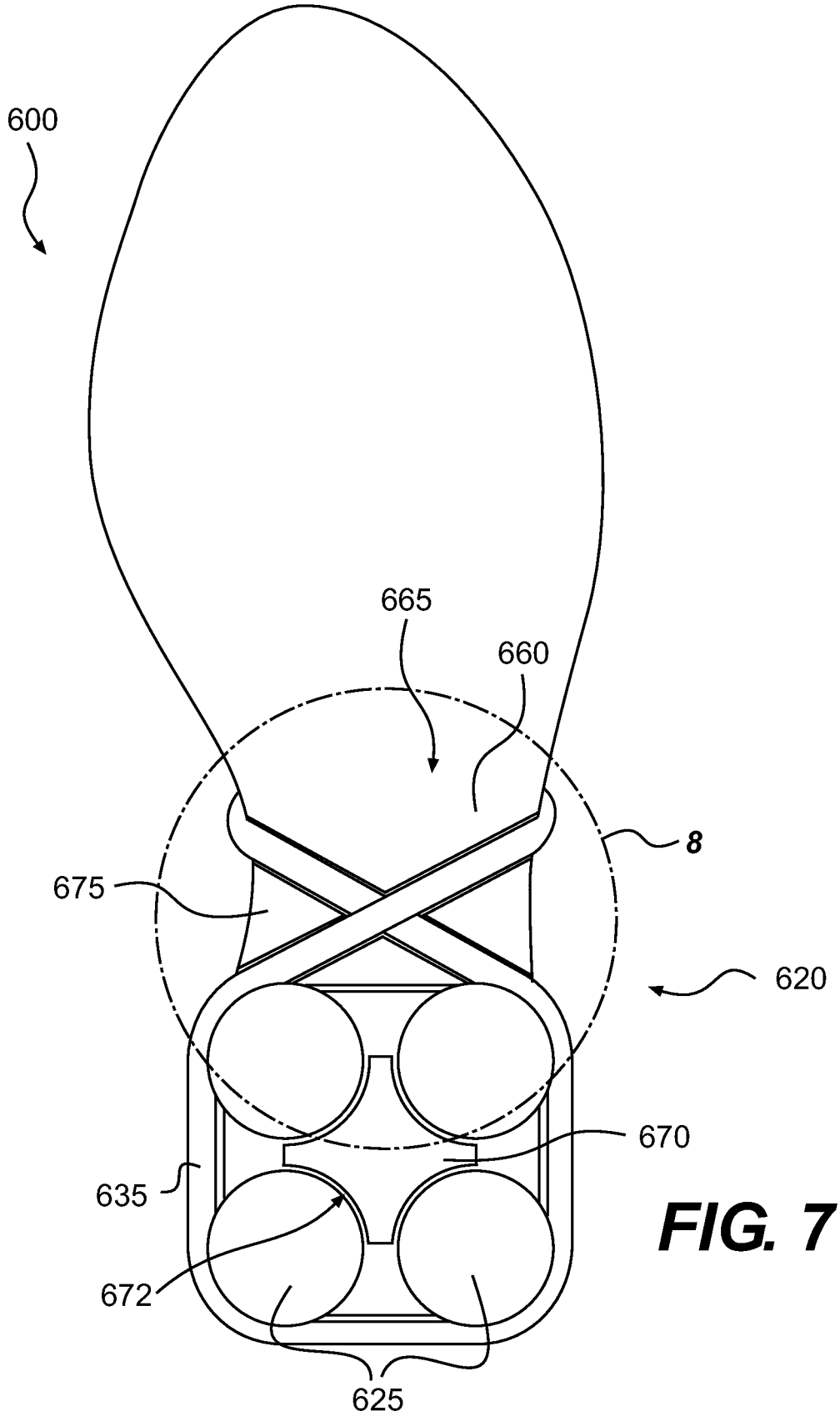
FIG. 7 is a bottom view of the article of footwear shown in FIG. 6, with a ground-engaging sole component removed.

FIG. 7 is a bottom view of the embodiment of FIG. 6 with ground engaging sole component 615 removed for purposes of illustration. As illustrated in FIG. 7, housing 635 crisscrosses through opening 660 in arch region 665. In order to facilitate this crisscrossing, the midsole may include a grooved plate 675.

As also shown in FIG. 7, adjustment system 620 may include a spacer 670 that operates similarly to spacer 555. Spacer 670 may include one or more indentations 672 configured to receive support members 625. For example, as shown in FIG. 7, in some embodiments, each of support members 625 may be located within one of a plurality of indentations 672. In some embodiments, support member 670 may fit between support members 625 with a small space between support members 625 and spacer 670. This may allow for deformation of support members 625 caused by compression during use. In other embodiments, spacer 670 may fit relatively snugly between support members 625. This may impart more control and influence over the adjustability that can be achieved with system 620. In some embodiments, spacer 670 may be absent.

Figure 8:
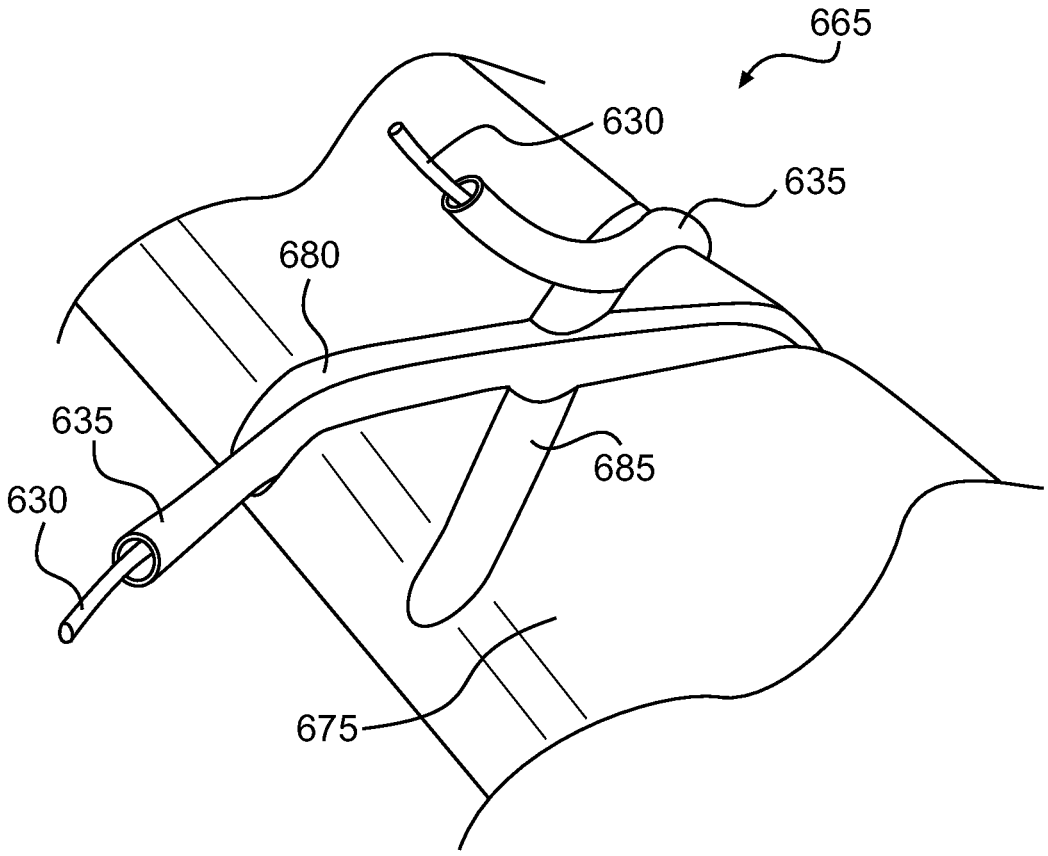
FIG. 8 is an enlarged perspective view of an arch region of the article of footwear shown in FIGS. 6 and 7.

FIG. 8 is an enlarged view of grooved plate 675 in arch region 665 of footwear 600. As shown in FIG. 8, footwear 600 may be provided with crisscrossing grooves that enable housing 635 to crisscross in arch region 665 without causing binding of tensile member 630 at the intersection. For example, plate 675 may include a first groove 680 and a second groove 685. As shown in FIG. 8, first groove 680 may be deeper than second groove 685 in order to allow overlap of housing 635 with itself without binding. It should also be noted that, while in some embodiments, housing 635 may be exposed, as shown in FIGS. 6-8, in other embodiments, part or all of housing 635 may be encased within other shoe components. Accordingly, in some embodiments, plate 675 may include crisscrossing through holes (tunnels) through which housing 635 may pass.

Figure 10:
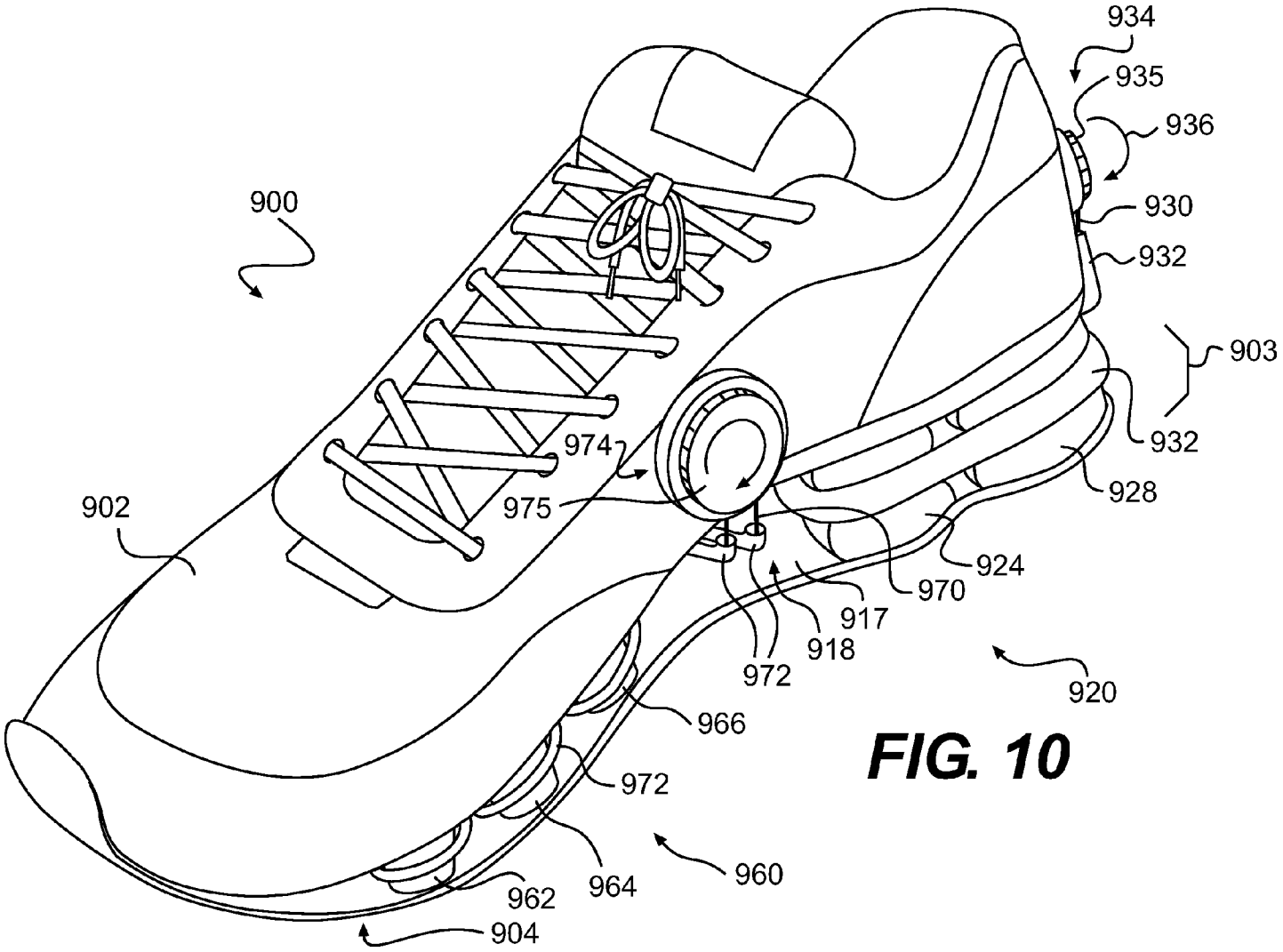
FIG. 10 is a perspective view of the article of footwear shown in FIG. 9.
Figure 11:
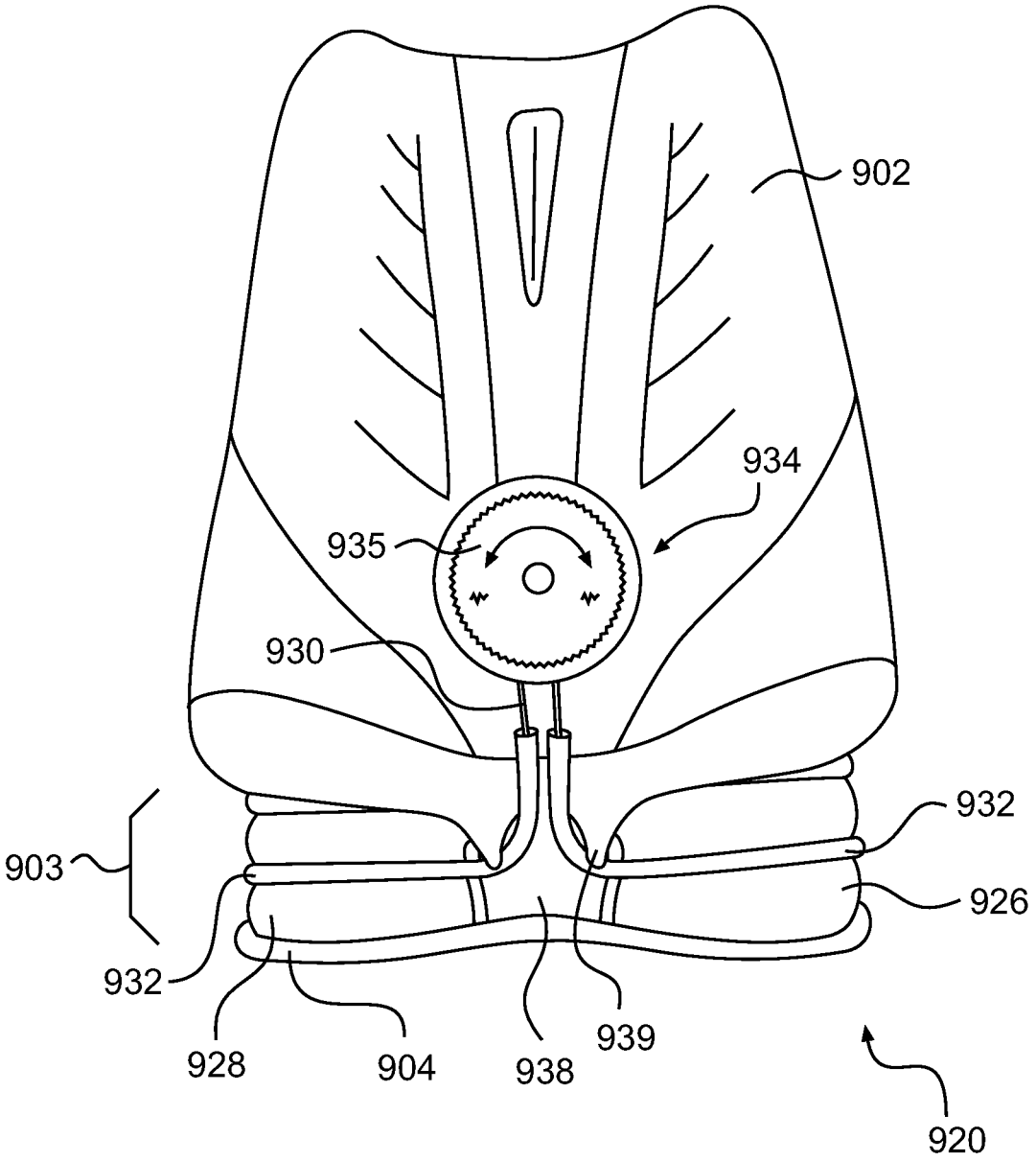
FIG. 11 is a rear elevation view of the article of footwear shown in FIGS. 9 and 10.

For reasons discussed above, it may be desirable to provide independent adjustability for different parts of a sole structure. For example, it may be desirable to provide a different adjustment for a heel region than a forefoot region. It may be further desirable to provide different adjustments for medial and lateral sides of an article of footwear. For example, FIGS. 9-11 illustrate an exemplary embodiment having three separate midsole adjustment systems, including a heel system, a medial forefoot system, and a lateral forefoot system.

Figure 9:
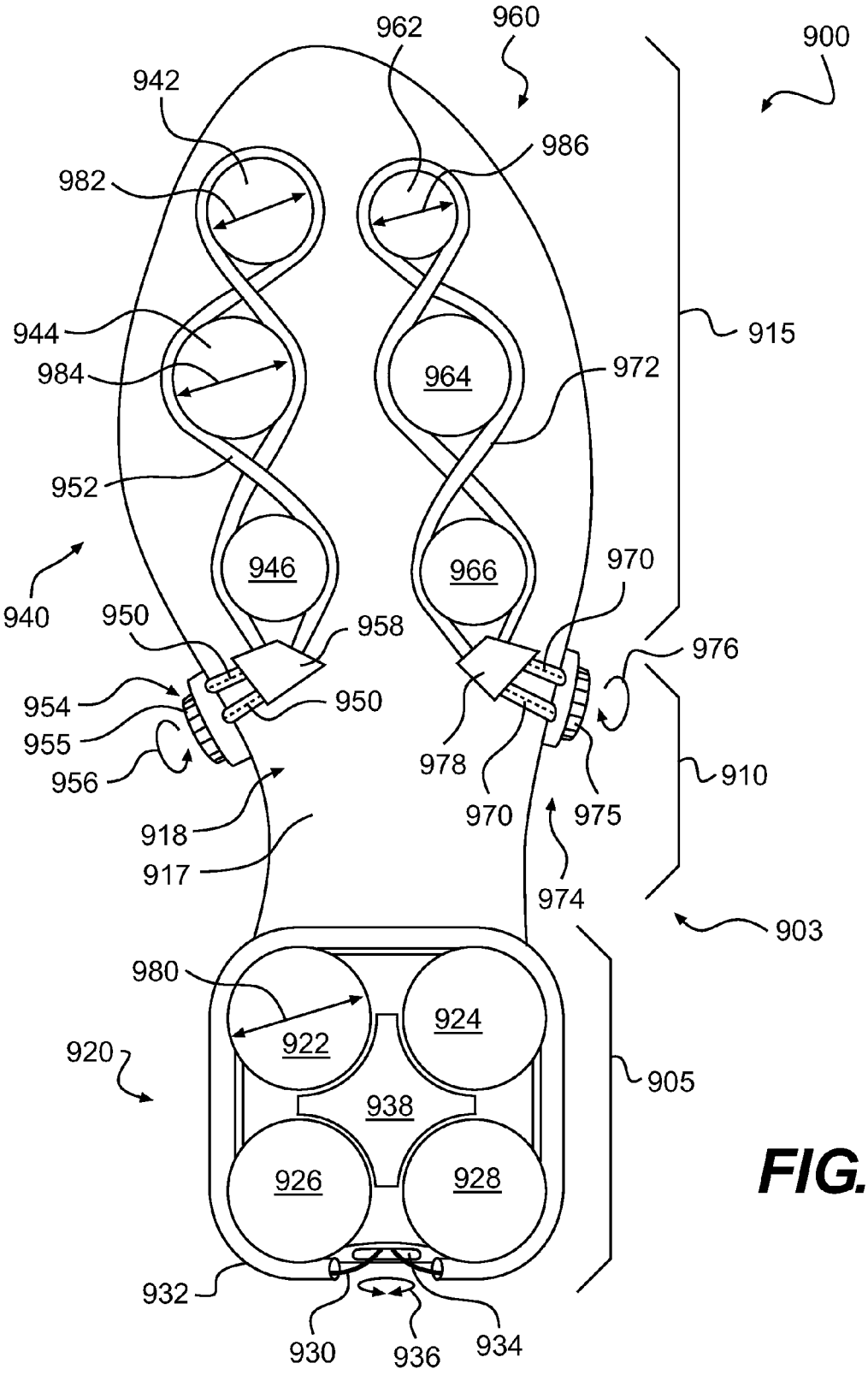
FIG. 9 is a bottom plan view of another exemplary article of footwear having a midsole adjustment system with a ground-engaging sole component removed.

FIG. 9 is a bottom side view of an article of footwear 900 with the ground engaging sole component removed, exposing various components of a sole structure 903. Footwear 900 may include a heel region 905, a midfoot region 910, and a forefoot region 915.

As shown in FIG. 9, footwear 900 may include a heel adjustment system 920 disposed in heel region 905. Heel adjustment system 920 may include a plurality of support members, including a first support member 922, a second support member 924, a third support member 926, and a fourth support member 928. Heel adjustment system 920 may also include a tensile member 930, which may be slidably disposed in a housing 932. Further, heel adjustment system 920 may include a tensioning device 934. In some embodiments, tensioning device 934 may be disposed on a rear (heel) portion of the upper of footwear 900, as shown in FIG. 9. In some embodiments, tensioning device 934 may be rotated, as indicated by an arrow 936, in order to tighten tensile member 930. In addition, heel adjustment system 920 may include a spacer 938. These components of heel adjustment system may be substantially similar to the components of system 620 discussed above and shown in FIGS. 6-8, with the exception of tensioning device 934 being located on a heel portion of footwear 900 instead of on an instep portion.

Footwear 900 may also include a medial adjustment system 940, which may be disposed in forefoot region 915. In some embodiments, portions of system 940 may be disposed in midfoot region 910, as shown in FIG. 9. Medial adjustment system 940 may include a plurality of support members, including, for example, a fifth support member 942, a sixth support member 944, and a seventh support member 946. In addition, medial adjustment system 940 may include a tensile member 950, which may be configured to substantially surround support members 942, 944, and 946. Tensile member 950 may be slidably disposed within a housing 952. Tensile member 950 may be tightened with a tensioning device 954. In some embodiments, tensioning device may include a dial 955, which may be rotated, for example, in a direction of an arrow 956 in order to tighten tensile member 950 about support members 942, 944, and 946.

In some embodiments, medial adjustment system 940 may also include a guide block 958. Guide block 958 may be configured to receive tensile member 950 and housing 952 and route these components to a medial side of the upper of footwear 900.

Footwear 900 may also include a lateral adjustment system 960. Lateral adjustment system 960 may include a plurality of support members, including an eighth support member 962, a ninth support member 964, and a tenth support member 966. Lateral adjustment system 960 may also include a tensile member 970, which may be slidably disposed in a housing 972. In addition, lateral adjustment system 960 may include a tensioning device 974. In some embodiments, tensioning device 974 may include a dial 975, which may be rotated in a direction 976 to effectuate adjustments in tension of tensile member 970.

Tensile members 950 and 970 and housings 952 and 972 may crisscross in between two or more of the support members. Such crisscross routing may be facilitated in a manner similar to the embodiment shown in FIGS. 6-8 regarding the crisscrossing of tensile members in an arch region 665 of footwear 600. Alternatively, housings 952 and 972 may be substantially enclosed within other footwear components.

As illustrated in FIG. 9, the support members may have different sizes in different regions of the footwear. For example, heel region support members may be larger than forefoot support members. In addition, certain forefoot support members may be larger than other forefoot support members, in order to tailor the midsole's properties to the loads produced by a foot. As shown in FIG. 9, first support member 922 may have a first diameter 980, fifth support member 942 may have a fifth diameter 982, sixth support member 944 may have a sixth diameter 984, and eighth support member 962 may have an eighth diameter 986. In some embodiments, diameters 980, 982, 984, and 962 may all be different from one another. This may be based on the general loading of a human foot. A large amount of weight may be placed on sixth support member 944, compared to eighth support member 962, which is disposed near the fifth phalanx. These differences in support member sizing may influence the effect tightening the tensile members may have on the support members.

In some embodiments, all support members on an article of footwear may have substantially the same structural properties. Alternatively, or additionally, different support members of an article of footwear may have different structural properties. As examples, the height, width, circumference, and other dimensions may vary between support members. Moreover, support members may be formed from different materials, or different densities of the same materials. In addition, some support members may be hollow, whereas others may be solid. Further, the performance characteristics of the support members may vary. For example, compressibility, stiffness, hardness, and other characteristics may vary from support member to support member.

FIG. 10 is a perspective view of footwear 900. As shown in FIG. 10, footwear 900 may include an upper 902 and sole structure 903. Sole structure 903 may include a ground engaging sole component 904. As illustrated in FIG. 10, tensioning device 974 may be disposed on a lateral side of footwear 900, with housing 972 routed to tensioning device 974 from an opening 917 in an arch region 918 of footwear 900.

FIG. 11 is a rear view of footwear 900. As shown in FIG. 11, tensioning device 934 may be disposed on a rear heel portion of footwear 900. FIG. 11 also shows housing 932 proceeding laterally across the back of support members 926 and 928, around a housing guide 939, and up toward tensioning device 934. In some embodiments, housing 932 may terminate short of tensioning device 934, exposing a portion of tensile member 930, as shown in FIG. 11. In other embodiments, housing 932 may fully enclose tensile member 930.

Figure 12:
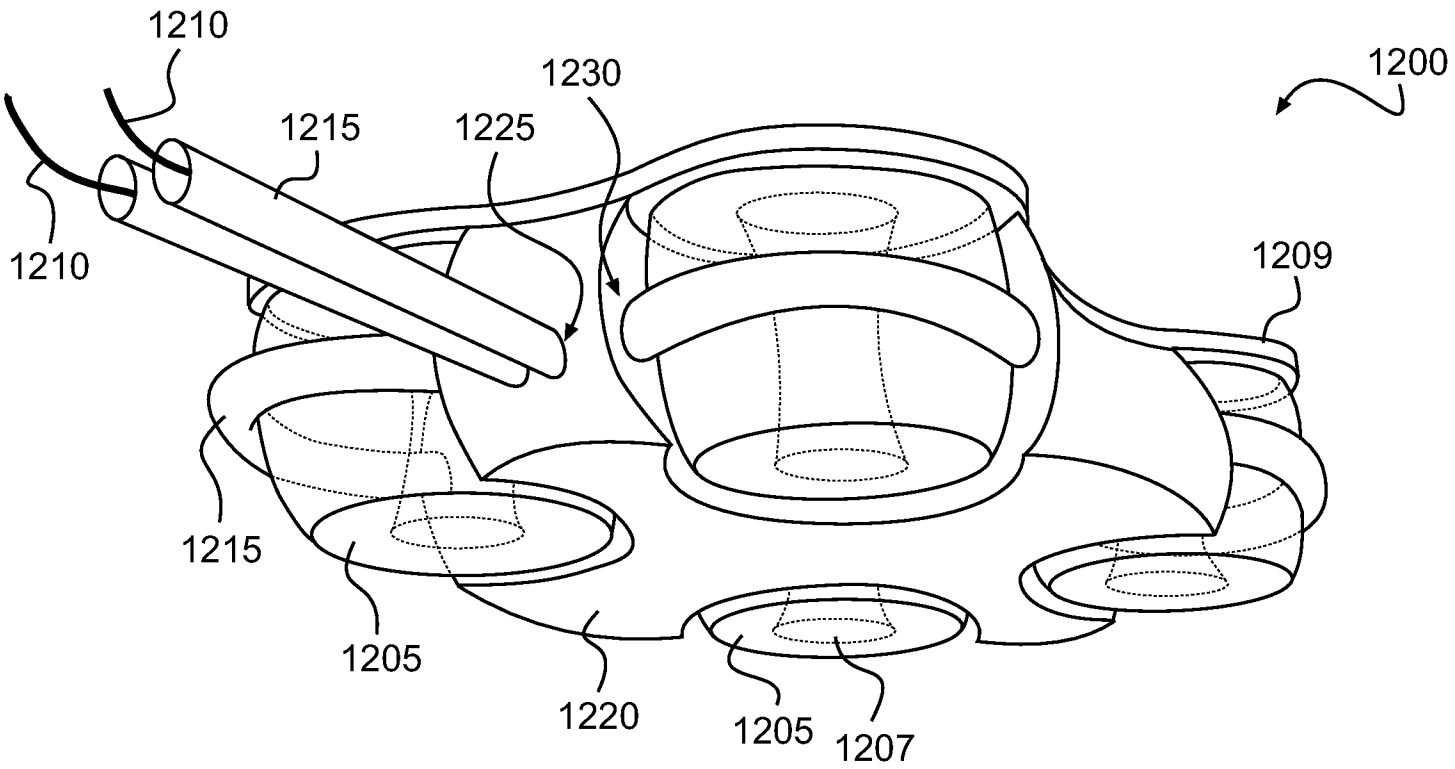
FIG. 12 is a perspective view of another midsole adjustment system.

Another midsole adjustment system 1200 that may be utilized in place of adjustment system 155 in footwear 110 is depicted in FIG. 12. Midsole adjustment system 1200 may include a plurality of support members 1205. As also shown in FIG. 12, in some embodiments, support members 1205 may be hollow, and thus, may define an internal cavity 1207. Support members 1205 may be disposed on a support plate 1209. In some embodiments, support plate 1209 may be substantially rigid, in order to distribute ground reaction forces from and between the plurality of support members 1205. System 1200 may include a tensile member 1210, which may be disposed in a housing 1215.

Adjustment system 1200 may include a differently shaped, spacer 1220. For example, spacer 1220 may extend further around the circumference of each support member 1205. This may provide additional control of the adjustment, additional stability, and/or additional stiffness, both in terms of vertical compliance and lateral stiffness. A further feature of midsole adjustment system 1200 relates to the routing of housing 1215, which extends through spacer 1220. More particularly, housing 1215 may enter and/or exit spacer 1220 at junctions 1225 and 1230. This configuration may be utilized to secure housing 1215 at a desired location relative to the height of the support members. Although depicted as being secured about halfway up the sidewall of support members 1205, housing 1225 and tensile member 1210 may be located in other positions. In addition, in some embodiments, housing 1225 and tensile member 1210 may be oriented at an angle with respect to the horizontal. For example, in some cases, it may be desirable to provide more or less cushion at an edge of support members that face an outer edge of the sole component. For instance, it may be desirable to provide more (or less) compliance at a rearmost edge of a heel portion of a sole structure. Similarly, different levels of compliance may be desired at forward, medial, and/or lateral edges of footwear. Accordingly, an angled orientation of housing and tensile members may provide a support member with compliance that has a gradient (increasing or decreasing with distance from the edge of the footwear).

Adjustable Width Component

In some cases, it may be desirable for a wearer to be able to customize the width and, therefore, the fit of their footwear. In some embodiments, a plurality of elongate members may be deformed, using wire tension forces, to narrow the structure.

Figure 13:
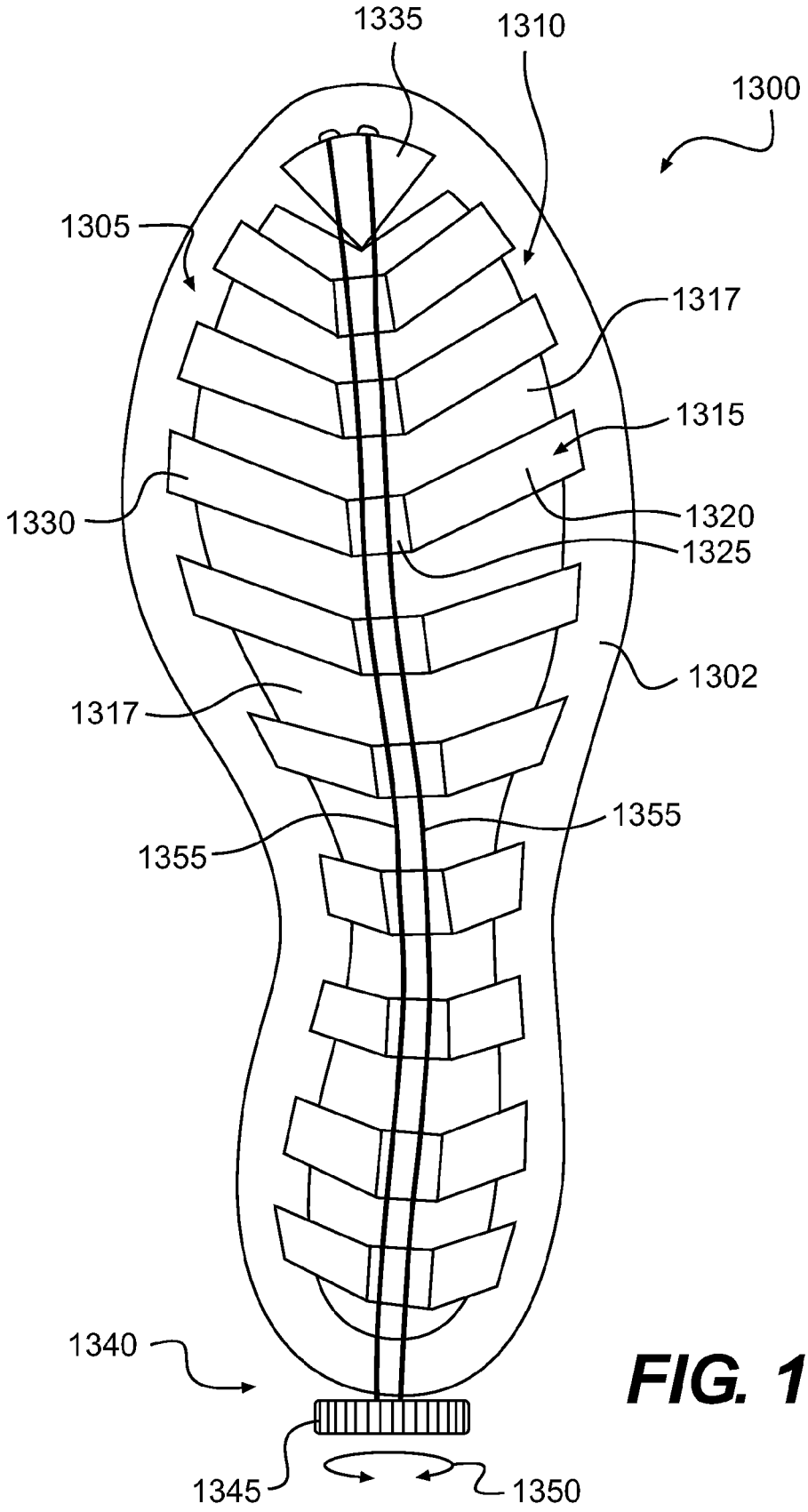
FIG. 13 is a schematic bottom plan view of an article of footwear having a width adjustment system.

FIG. 13 illustrates a bottom view of an alternative implementation of tensile members configured to be tightened in order to alter the configuration of a sole structure. FIG. 13 shows a schematic illustration of a sole structure of an article of footwear 1300. Footwear 1300 may include an upper 1302 configured substantially as described elsewhere in this disclosure. As shown in FIG. 13, a portion of upper 1302 may wrap at least partially in a horizontal direction under the cavity formed by upper 1302. In addition, footwear 1300 may include a sole structure 1305, including an adjustable width component 1310. Adjustable width component 1310 may include at least one row of flexible elongate members 1315 extending substantially horizontally. In some embodiments, elongate members 1315 may extend in a lateral direction. Elongate members 1315 may each include a first portion 1320, a second portion 1330, and a third portion 1325 between first portion 1320 and second portion 1330.

Elongate members 1315 may be formed of any suitably flexible material. In some embodiments, elongate members 1315 may serve as cushioning components for footwear 1300, configured to attenuate ground forces. Accordingly, in some embodiments, elongate members 1315 may be formed of a resilient foam, for example. In some embodiments, elongate members 1315 may include fluid-filled portions containing, for example, liquids, gels, and/or gases.

Adjustable width component 1310 may also include additional elongate members 1317. Additional elongate members 1317 may also serve as cushioning components. Accordingly, additional elongate members 1317 may have similar features and may be formed of similar materials to elongate members 1315, as discussed above. In some embodiments, the elongate members 1315 and additional elongate members 1317 may be differently configured. In some embodiments, elongate members 1315 and additional elongate members 1317 may alternate to form adjustable width component 1310. For example, in some embodiments, elongate members 1315 may be fluid filled components and additional elongate members 1317 may be foam components, and the two types of components may alternate, as shown in FIG. 13. In some embodiments, the medial and lateral ends of elongate members 1315 may be fixedly attached to upper 1302, for example at the horizontally extending portions shown in FIG. 13.

In addition, sole structure 1305 may include a substantially rigid member 1335 at one end of the row of elongate members. Rigid member 1335 may be fixedly attached to at least one tensile member 1355, which may, in turn, be connected to a tensioning device 1340 at an opposite end of the row of elongate members. For example, in some embodiments rigid member 1335 may be disposed at a forward portion of footwear 1300 and tensioning device 1340 may be disposed at a rear portion of footwear 1300, with tensile member 1355 extending in a substantially longitudinal direction, spanning the distance between these two components. Thus, in some embodiments, adjustable width component 1310 may extend substantially the entire length of footwear 1300, as shown in FIG. 13. In other embodiments, adjustable width component 1310 may extend over shorter segments of footwear 1300, such as the forefoot region or the heel region.

Figure 14:
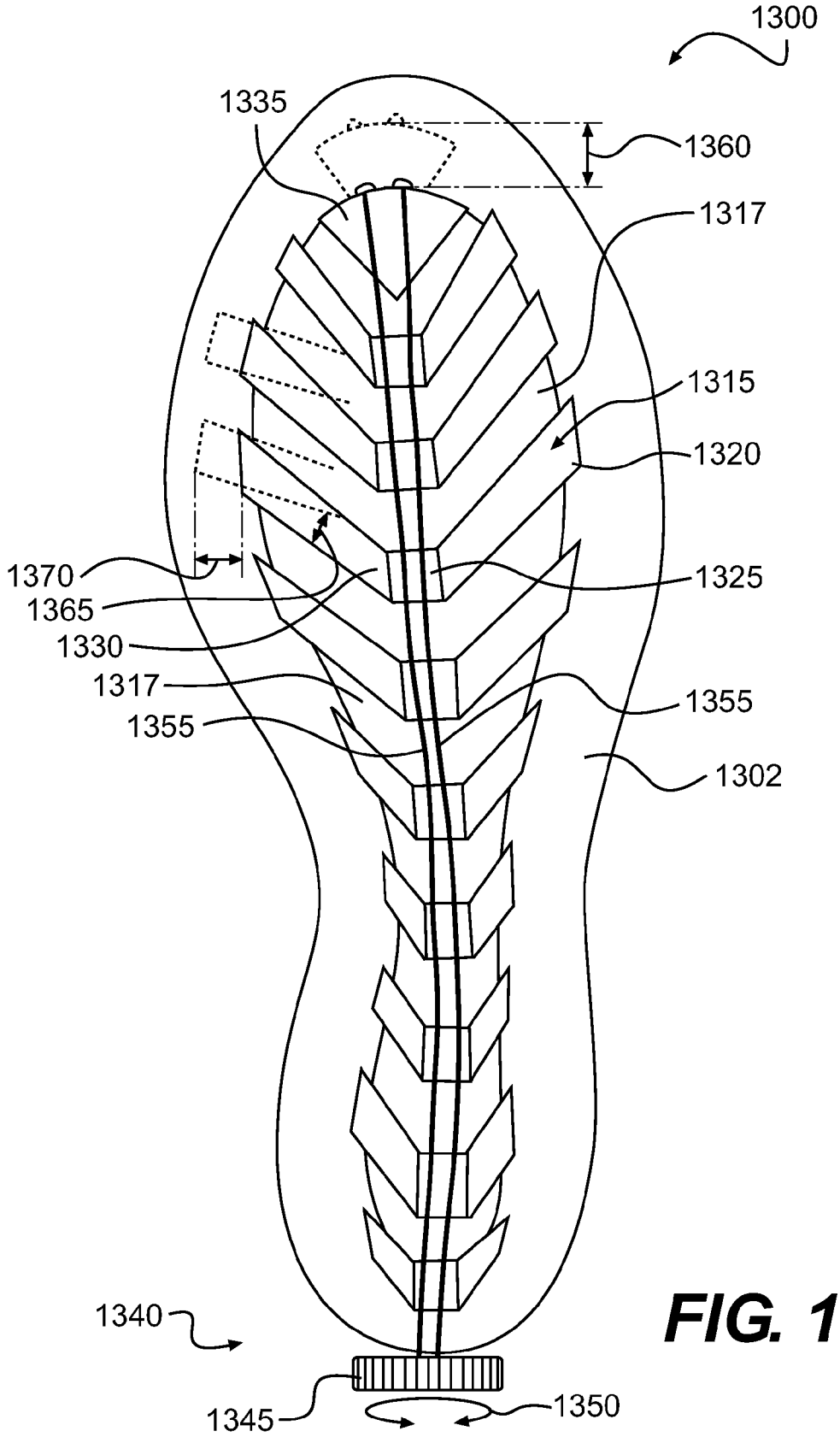
FIG. 14 is a schematic bottom plan view corresponding with FIG. 13 and depicting the article of footwear in an adjusted configuration.

Tensioning device 1340 may include, for example, a dial 1345, which may be turned (as indicated by an arrow 1350) to retract tensile member 1355. Accordingly, tensioning device 1340 may be configured to pull substantially rigid member 1335 toward tensioning device 1340 via tensile member 1355. For example, as shown in FIG. 14, tensioning device 1340 may be operated to pull tensile members 1355, which pulls rigid member 1335 toward tensioning device 1340. FIG. 14 illustrates longitudinal translation of rigid member 1355 by a distance 1360. Rigid member 1335 may have a lateral width that is shorter than elongate members 1315 so that only the central portion of each elongate member is pulled toward tensioning device 1340. For example, in some embodiments, rigid member 1335 may include a pointed portion oriented toward tensioning device 1340, configured to focus the pulling forces generated by tensioning device 1340 and tensile member 1355 against the central portions of elongate members 1315. Accordingly, pulling rigid member 1335 toward tensioning device 1340 may, in turn, pull third portion 1325 of each elongate member 1315 closer to tensioning device 1340.

First and second portions 1320 and 1330 of each elongate member 1315 may be fixedly attached to a peripheral portion of the sole structure. In some embodiments, first and second portions 1320 and 1330 of each elongate member 1315 may be fixedly attached to the portions of upper 1302 that wrap around the bottom portion of the cavity defined by upper 1302. Accordingly, first and second portions 1320 and 1330 of each elongate member 1315 may remain in place, and thus, substantially the same distance from tensioning device 1340 while third portion 1325 is translated longitudinally. This may result in first and second portions 1320 and 1330 of each elongate member 1315 becoming closer to one another (as the V configuration of elongate members 1315 become deeper, that is, more acutely angled). By drawing first and second portions 1320 an 1330 closer to one another, adjustable width component 1310 may be narrowed, which may reduce the width of the foot receiving cavity defined by upper 1302. As illustrated in FIG. 14, the central portion of elongate member 1315 may be moved toward tensioning device a distance indicated by a dimension 1365. This may result in movement of the medial edge of elongate member 1315 laterally by a distance indicated by a dimension 1370 in FIG. 14.

Since elongate support members 1315 may be resilient, when the tension provided by tensioning device 1340 is released, elongate support members 1315 may return to the undeformed configuration, allowing the width of adjustable width component 1310 to increase back to the original size. In some embodiments, tensioning device 1340 may be configured to allow the release of tensile members to be controlled, for example, by turning dial 1345 in the opposite direction to the tightening direction. In other embodiments, the tension on tensile member 1355 may be fully released, for example, by simply by pushing or pulling dial 1345. Thus, a tensioning system may be implemented to adjust the width of an article of footwear. Such a system may include, for example, an elongate member may have a first end, a second end, and a central portion. By pulling on the central portion in a direction transverse to the long axis of the elongate member, the elongate member may be deformed to have a "V" shape, with the first end and the second end at the two top parts of the "V," and the central portion at the bottom of the "V." Accordingly, in the deformed configuration, the first and second ends are closer to one another than when the elongate member is fully extended. By fastening the first and second ends of the elongate members to the medial and lateral portions, respectively, of an article of footwear, the width of the article of footwear may be adjusted by applying tension longitudinally on the central portions of the elongate members.

Figure 15:
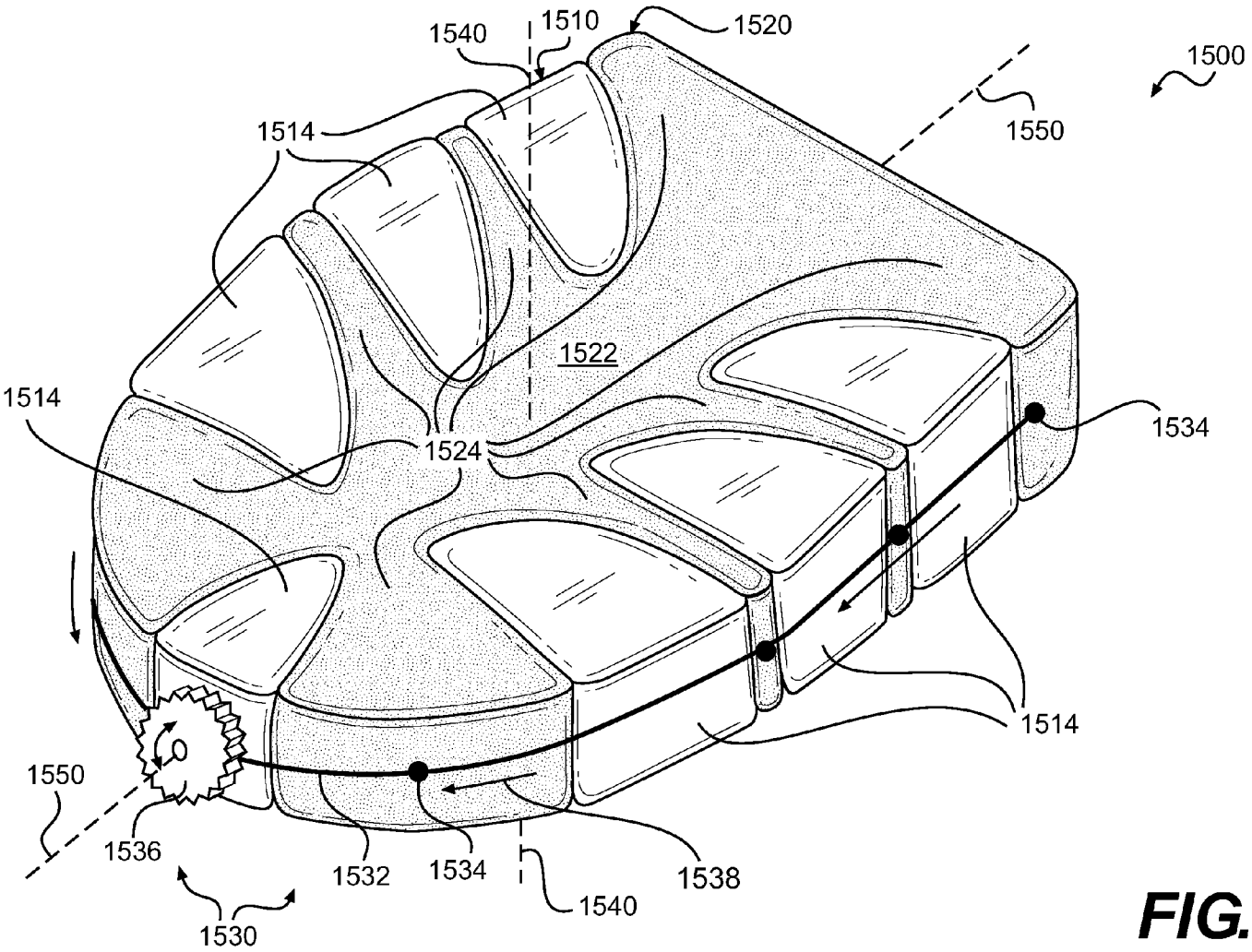
FIG. 15 is a perspective view of a sole system for an article of footwear in an assembled configuration.

FIG. 15 illustrates a sole system 1500 for an article of footwear. Sole system 1500 may have any suitable shape and/or size. For example, in some configurations, sole system 1500 may be configured to be located in a heel region of the article of footwear, as shown in FIG. 15. In some cases, sole system 1500 may have a full-length configuration, essentially extending through forefoot, midfoot, and heel regions of the footwear. In other configurations, sole system 1500 may extend a partial length of the footwear, such as through only a heel region and midfoot region, or only through a heel region and forefoot region.

Sole system 1500 may include a chamber 1510 configured to contain pressurized fluid. Chamber 1510 may be formed of bladder material and pressurized in configurations similar those described above. Chamber 1510 may include a base portion 1512 and a plurality of peripheral subchambers 1514 extending upward from base portion 1512. The size and/or shape of peripheral subchambers 1514 may be configured to provide various desired performance characteristics.

As illustrated in FIG. 15, sole system 1500 may also include a mating component 1520. Mating component 1520 may be configured to mate with the contours of chamber 1510. For example, mating component 1520 may include a central portion 1522 and a plurality of peripheral portions 1524 extending substantially radially from central portion 1522 of mating component 1520. As shown in FIG. 15, peripheral portions 1524 may extend between peripheral subchambers 1514. For example, as shown in FIG. 15, peripheral portions 1524 may include projecting members that project substantially radially from central portion 1522 of mating component 1520.

In some configurations, mating component 1520 may include a substantially incompressible material, such as a relatively hard plastic, carbon fiber, or other composite material. In some configurations, mating component 1520 may include a minimally compressible material, such as a relatively hard rubber or moderately compressible rubber. In some configurations mating component 1520 may include a relatively compressible material, such as a relatively soft rubber, gel-filled chamber, or a foam material. For example, in some configurations, mating component 1520 may include a compressible foam material, such as ethyl vinyl acetate (EVA) or other such foam materials.

In some configurations, sole system 1500 may include an adjustment system 1530 configured to vary one or more performance characteristics of sole system 1500. For example, adjustment system 1530 may be configured to vary the compressibility (cushioning), responsiveness, stability, and/or other performance characteristics of sole system 1500.

Adjustment system 1530 may include a tensile member 1532 anchored to the peripheral portions of mating component 1520. In addition, adjustment system 1530 may include a tensioning device 1536 configured to apply tension to tensile member 1532 and thereby alter one or more performance characteristics of sole system 1500 by applying pressure to peripheral subchambers 1514 between peripheral portions 1524 of mating component 1520. Tensioning device 1536 may be configured to apply tension in tensile member 1532 in a direction indicated by arrow 1538, as shown in FIG. 15.

Exemplary features and configurations of tensile member 1532 and tensioning device 1536 are described above in conjunction with other disclosed embodiments. For example, tensile member 1532 may include an elongate member, such as a wire, chord, rope, cable, ribbon, or other such tensile member. Also for example, tensioning device 1536 may include a dial or other control input device configured to vary the tension on tensile member 1532. For example, tensioning device 1536 may be configured to wind an end of tensile member 1532 to thereby apply tension to tensile member 1532.

Tensile member 1532 may be fixedly attached to peripheral portions 1524 of mating component 1520 in any suitable manner. For example, tensioning member 1532 may be secured to peripheral portions 1524 at anchor points 1534 using adhesive, mechanical fasteners, or other attachment structures. Anchor points 1534 are illustrated schematically in FIG. 15. As shown in FIG. 15, anchor points 1534 may secure tensile member 1532 to the ends of peripheral portions 1524 of mating component 1520.

Tensioning device 1536 is also shown schematically in FIG. 15. Tensioning device 1536 may be fixedly attached to the article of footwear in any suitable manner. In some configurations, tensioning device 1536 may be fixedly attached to sole system 1500. For example, as shown in FIG. 15, tensioning device 1536 may be located in a rearward-most position. In other configurations, tensioning device 1536 may be located elsewhere, such as on a medial or lateral side of sole system 1500. Also, tensioning device 1536 may be secured to chamber 1510, as shown in FIG. 15, or secured to mating component 1520. In still other configurations, tensioning device 1536 may be fixedly attached to other portions of the footwear incorporating sole system 1500. For example, it may be advantageous to secure tensioning device 1536 to an upper of the article of footwear. In some configurations, it may be beneficial to fixedly attach tensioning device 1536 to a relatively rigid component of the footwear, such as a heel counter.

Figure 16:
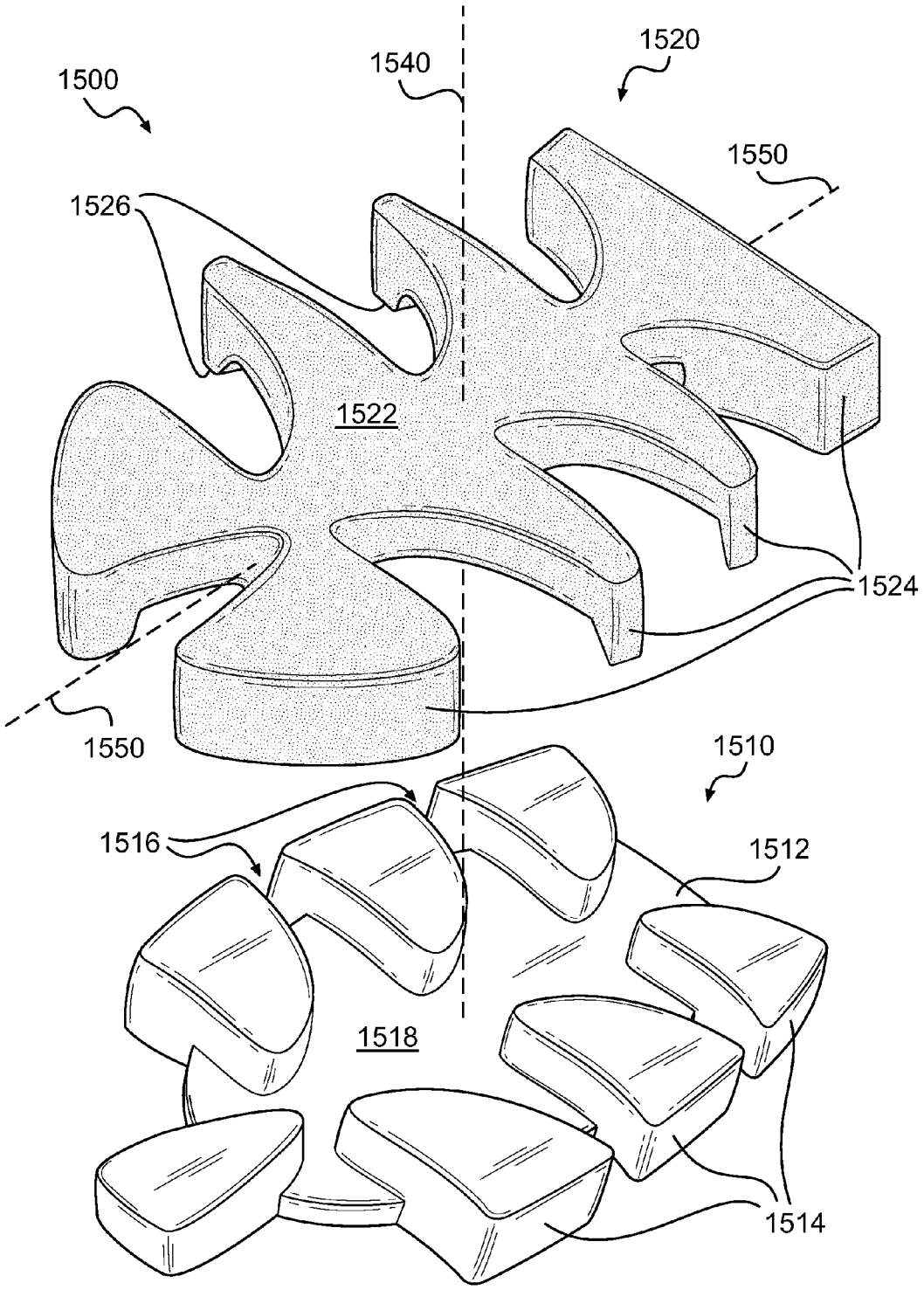
FIG. 16 is a perspective, exploded view of components of the sole system shown in FIG. 15.

FIG. 16 is an exploded view of portions of sole system 1500. FIG. 16 illustrates chamber 1510 and mating component 1520, but omits adjustment system 1530. With chamber 1510 and mating component 1520 separated, as shown in FIG. 16, the interlocking structures of these two components are shown. For example, recesses 1516 may be provided between subchambers 1514. Peripheral portions 1524 of mating component 1520 may extend into recesses 16 between peripheral subchambers 1514.

In addition, peripheral portions 1524 may include downwardly projecting peripheral portions 1526, which may extend downward between peripheral subchambers 1514 when assembled. In some configurations, downwardly projecting peripheral portions 1526 may extend the full height of sole system 1500, as shown in FIGS. 15 and 16. Similarly, peripheral subchambers 1514 may also extend a full height of sole system 1500.

It will be noted that, in some configurations, sole system 1500 may be incorporated into footwear in the illustrated orientation. In other configurations, sole system 1500 may be inverted, when incorporated into footwear. That is, chamber 1510 may be located on the top, and mating member 1520 may be located on the bottom. Therefore, downwardly projecting peripheral portions 1526 may, in some configurations, project upwardly. Similarly, the locations of other upper and lower components may be reversed.

In some configurations, chamber 1510 may include a base portion 1518, as shown in FIG. 16. Peripheral subchambers 1514 may extend upward from base portion 1512. In addition, peripheral subchambers 1514 may extend substantially radially from a central portion 1518 of chamber 1510.

In some configurations, base portion 1512 may be configured to contain a pressurized fluid. In some such configurations, the interior of base portion 1512 may be in fluid communication with at least one of peripheral subchambers 1514. In some configurations, the interior of base portion 1512 may be is isolated from peripheral subchambers 1514. In some configurations, base portion 1512 may not contain a fluid. In such configurations, base portion 1512 may simply be a carrier for peripheral subchambers 1514.

As shown in FIG. 16, central portion 1518 of chamber 1510 and central portion 1522 of mating component 1520 may be located substantially proximate to a central vertical axis 1540. Central portion 1518 and central portion 1522 may also be located substantially along a central longitudinal axis 1550.

The sizes and/or shapes of chamber 1510 and mating component 1520 may be varied to achieve desired performance characteristics. For example, the combination of a fluid-filled bladder and foam material member provides particular cushioning, stability, and responsiveness to the sole system. Some portions of sole system 1500 may include sections in which chamber 1510 extends a full height of sole system 1500, some portions may include sections where mating component 1520 extends a full height of sole system 1500, and some portions may include both chamber 1510 and mating component 1520 are combined to form the height of sole system 1500. By varying the sizing, shapes, and distribution of the subsections of chamber 1510 and mating component 1520, the performance characteristics may be tuned to take advantage of desirable aspects of the materials from which these two components are formed.

Figure 17:
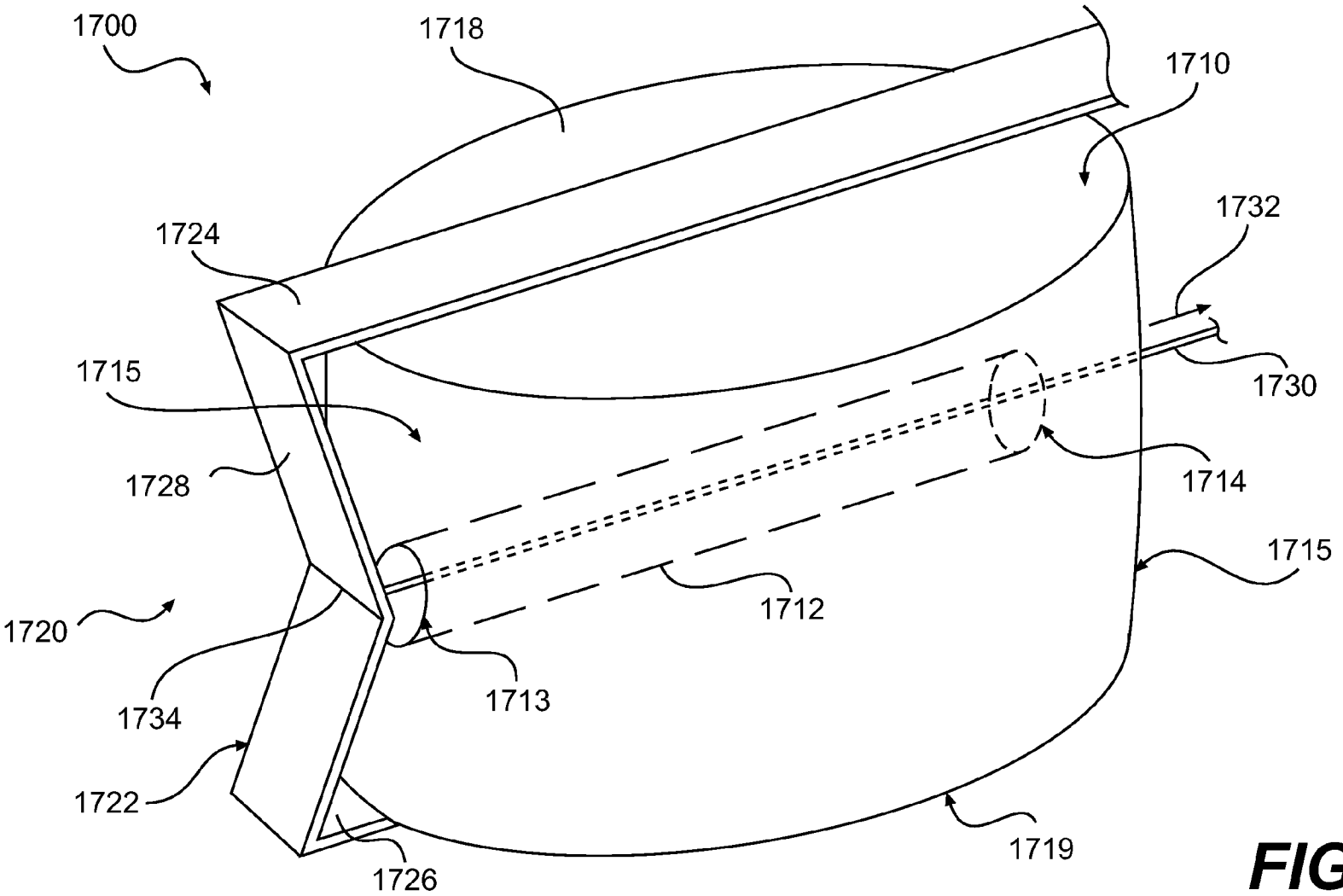
FIG. 17 is a perspective view of a sole system for an article of footwear.

FIG. 17 illustrates a sole system 1700. As shown in FIG. 17, sole system 1700 may include at least one support member 1710. Support member 1710 may be a part of a sole structure, such as a midsole. Accordingly, support member 1710 may be configured to control ground reaction forces. For example, support member 1710 may be configured to provide cushioning and/or stability. Support member 1710 may include features and characteristics of support members discussed above. For example, support member 1710 may be a compressible member. Accordingly, support member 1710 may be formed of a suitable compressible material, such as foam or rubber. Further support member 1710 may be a chamber configured to contain a pressurized fluid, or a chamber including a gel.

Support member 1710 may have any suitable shape. For example, as shown in FIG. 17, support member 1710 may have a substantially cylindrical shape. In other configurations, support member 1710 may have other shapes, such as a rectangular prism or a frustoconical shape. Further details provided above with respect to other support member embodiments are applicable to support member 1710.

Support member 1710 may include a top portion 1718, a bottom portion 1719, and a sidewall surface 1715. In some configurations, support member 1710 may also include a through hole 1712 extending from a first opening 1713 in a first area of sidewall surface 1715 to a second opening 1714 in a second area of sidewall surface 1715, as shown in FIG. 17.

As also shown in FIG. 17, sole system 1700 may include an adjustment system 1720, which may include a tensile member 1730 extending through the through hole 1712 of support member 1710, and a tensioning device (not shown in FIG. 17, but shown and described elsewhere herein in conjunction with other embodiments). Adjustment system 1720 may be configured to selectively alter one or more performance characteristics of support member 1710 by adjusting tension in tensile member 1730. Tensile member 1730 and the tensioning device may have similar features and characteristics of tensile members and tensioning devices discussed above.

Adjustment system 1720 may also include a compression member 1722. Compression member 1722 may include an upper member 1724 located above support member 1710, a lower member 1726 located below support member 1710, and a side member 1728 connecting upper member 1724 and lower member 1726 and located along, but spaced from, sidewall surface 1715 of support member 1710. At least one of upper member 1724 and lower member 1726 may include a substantially flat panel configured to apply pressure against support member 1710 over a surface area. In some configurations, the surface area over which upper member 1724 or lower member 1726 applies pressure to support member 1710 may be less than a surface area of a corresponding upper surface (1718) or lower surface (1719) of support member 1710.

Tensile member 1730 may be connected to side member 1728 such that increasing tension in tensile member 1730 applies a force to side member 1728 in a direction toward sidewall surface 1715 of support member 1710 (the direction being indicated in FIG. 17 by an arrow 1732). As shown in FIG. 17, side member 1728 may include a hinge portion 1734 proximate to a point at which tensile member 1730 is connected to side member 1728. In some configurations, hinge portion 1734 may include a living hinge. Accordingly, applying this tension may thereby apply an upward force to lower member 1726 and a downward force to upper member 1724, thus altering one or more performance characteristics of support member 1710 by applying a vertical compressive force against support member 1710.

Sole system 1700 may be configured such that the application of a vertical compressive force against support member 1710 compresses support member 1710. This may change a height of support member 1710. Compressing the height of support member 1710 may also alter the performance characteristics of support member 1710, such as compressibility, stability, and other attributes. For example, the application of a vertical compressive force against support member 1710 to reduce the height of support member 1710 may change the compressibility of support member 1710, for instance by reducing the compressibility. Thus, the adjustment system may be configured to apply vertical compressive forces to support member 1710, thereby reducing the compressibility of support member 1710 by preloading support member 1710.

Figure 18A:
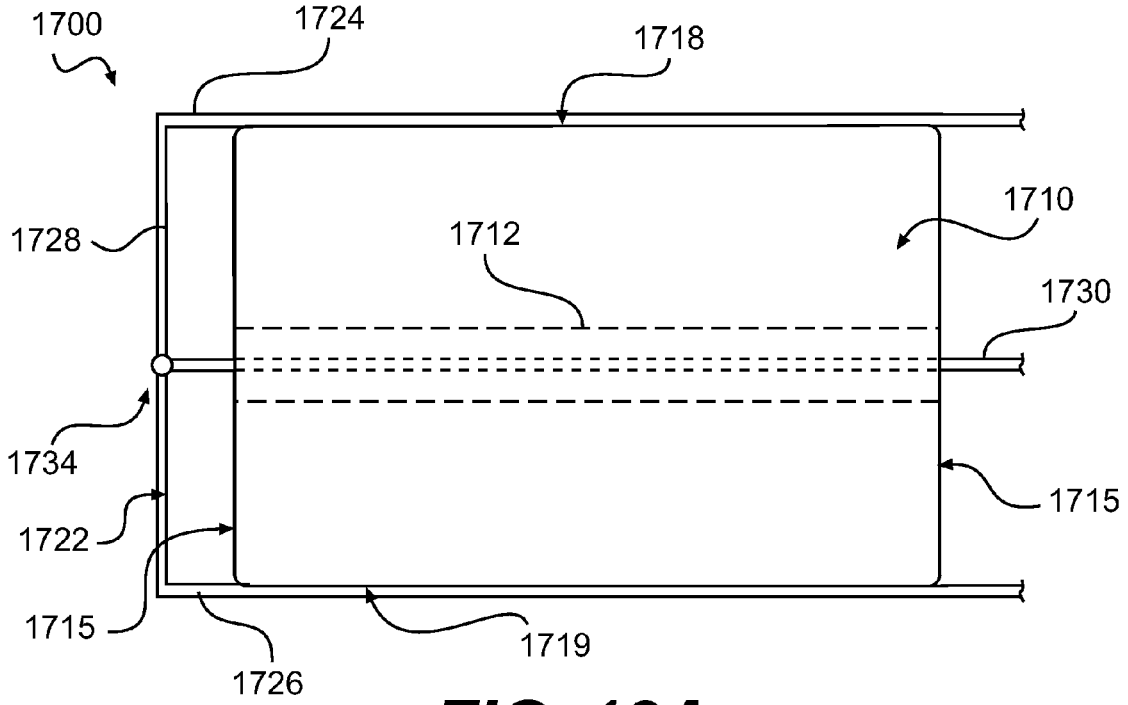
FIG. 18A is a side elevation view corresponding with FIG. 17, showing the sole system in an uncompressed condition.

FIG. 18A illustrates an elevation view of sole system 1700 in an uncompressed condition. As shown in FIG. 18A, when sole system 1700 is in an uncompressed condition, upper member 1724 and lower member 1726 may be substantially parallel to one another and side member 1728 may be in a substantially straight configuration.

Figure 18B:
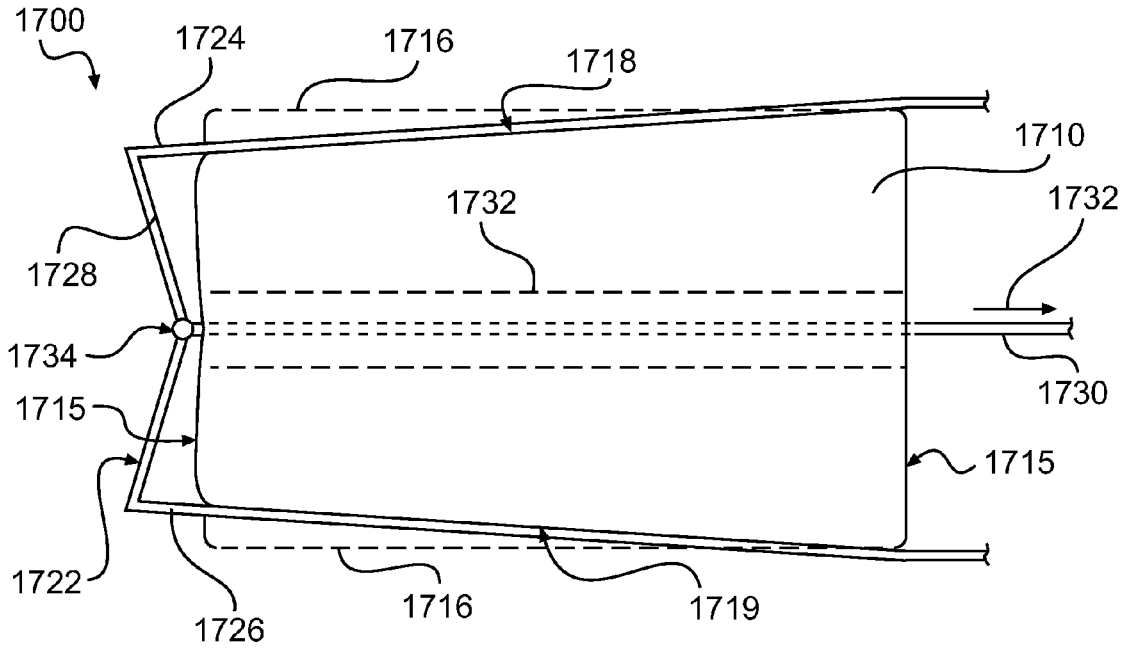
FIG. 18B is a side elevation view corresponding with FIG. 17, showing the sole system in a compressed condition.

FIG. 18B illustrates sole system 1700 in a compressed condition. As shown in FIG. 18B, when tensile member 1730 is pulled by a tensioning device in the direction of arrow 1732, tensile member 1730 may pull a central portion of side member 1728 toward sidewall surface 1715 of support member 1710. When side member 1728 is pulled toward sidewall surface 1715, side member 1728 may articulate at hinge portion 1734. Further, when side member 1728 is pulled toward sidewall surface 1715, upper surface 1724 and lower surface 1726 may be pulled toward one another by the articulation of side member 1728, as shown in FIG. 18B.

The compression of support member 1710 is illustrated in FIG. 18B, by dashed lines 1716, which show the location of upper surface 1718 and lower surface 1719 when support member 1710 is in an uncompressed condition.

While various embodiments of the invention have been described, the description is intended to be exemplary, rather than limiting, and it will be apparent to those of ordinary skill in the art that many more embodiments and implementations are possible that are within the scope of the invention. Accordingly, the invention is not to be restricted except in light of the attached claims and their equivalents. Features of any embodiment described in the present disclosure may be included in any other embodiment described in the present disclosure. Also, various modifications and changes may be made within the scope of the attached claims.

What is claimed is:

1. An article of footwear having an upper and a sole structure secured to the upper, the sole structure comprising:

an outsole;

at least one a support member having a columnar structure and extending between the upper and the outsole; and a tensile member associated with the at least one support member and surrounding at least a portion of an outer perimeter of the at least one support member between the upper and the outsole;

wherein the article of footwear includes a tensioning device configured to selectively alter properties of the at least one support member by selectively tightening the tensile member around the outer perimeter of the at least one support member.

2. The article of footwear of claim 1, wherein the tensioning device is configured to selectively alter at least one of a vertical compliance of the at least one support member, a horizontal stiffness of the at least one support member, and a height of the at least one support member, by tightening the tensile member.

3. The article of footwear recited in claim 1, wherein the amount of the tensile member disposed around the outer perimeter of the at least one support member is reduced when the tensile member is tightened by the tensioning device.

4. The article of footwear recited in claim 1, wherein the support member defines an indentation, and a portion of the tensile member is located within the indentation.

5. The article of footwear recited in claim 1, wherein the tensile member includes a housing and a wire or cable, the wire or cable being located within the housing, and the housing contacting the support member.

6. The article of footwear recited in claim 1, wherein the tensioning device is secured to an exterior of the article of footwear.

7. The article of footwear recited in claim 1, wherein the at least one support member includes a longitudinal axis extending between the upper and the outsole, the longitudinal axis disposed substantially perpendicular to a ground-connecting surface of the outsole.

8. The article of footwear recited in claim 7, wherein the at least one support member is located in a heel region of the article of footwear.

9. An article of footwear having an upper and a sole structure secured to the upper, the sole structure comprising:

a void having a first surface and an opposite second surface, the first surface being positioned adjacent to the upper, and the second surface being positioned adjacent to a ground-engaging portion of the footwear;

at least one support member having a columnar structure located within the void and secured to the first surface and the second surface, the at least one support member having a longitudinal axis that extends between the upper and the ground-engaging portion of the footwear and is substantially perpendicular to the ground-engaging portion of the footwear; and a tensile member extending at least partially around an outer perimeter of the at least one support member and operable to be to selectively placed under tension to reduce the amount of the tensile member disposed around the outer perimeter of the at least one support member.

10. The article of footwear recited in claim 9, wherein the at least one support member has a cylindrical shape.

11. The article of footwear recited in claim 9, wherein the tensile member includes a housing and a wire or cable, the wire or cable being located within the housing, and the housing contacting the at least one support member.

12. The article of footwear recited in claim 9, wherein the at least one support member defines an indentation.

13. The article of footwear recited in claim 12, wherein the tensile member is at least partially located within the indentation.

14. The article of footwear recited in claim 12, wherein the tensile member extends within a housing, the housing disposed between the tensile member and the at least one support member.

15. The article of footwear recited in claim 9, further comprising a tensioning device operable to selectively alter properties of the at least one support member by tightening and loosening the tensile member.

16. The article of footwear recited in claim 15, wherein the tensioning device is supported by the upper.

17. The article of footwear recited in claim 15, wherein the tensioning device is configured to selectively alter at least one of a vertical compliance of the at least one support member, a horizontal stiffness of the at least one support member, and a height of the at least one support member, by tightening the tensile member.

18. The article of footwear recited in claim 1, wherein the tensile member is in contact with a first portion of an outer surface of the at least one support member within a first plane, the tensile member being spaced apart from a second portion of the outer surface in the same plane.

19. The article of footwear recited in claim 1, wherein the at least one support member includes a groove that surrounds the at least one support member, the tensile member being received within the groove.

20. The article of footwear recited in claim 19, wherein the amount of the tensile member received within the groove is reduced when the tensile member is placed under tension.

* * * * *